US007580666B2

(12) United States Patent
Kimura

(10) Patent No.: US 7,580,666 B2
(45) Date of Patent: Aug. 25, 2009

(54) FIXING MEMBER, FIXING DEVICE AND IMAGE FORMING APPARATUS

(75) Inventor: Jun Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 295 days.

(21) Appl. No.: 11/812,063

(22) Filed: Jun. 14, 2007

(65) Prior Publication Data

US 2008/0112736 A1 May 15, 2008

(30) Foreign Application Priority Data

Nov. 10, 2006 (JP) ..... 2006-305161

(51) Int. Cl.
*G03G 15/20* (2006.01)

(52) U.S. Cl. ..... 399/328; 399/333

(58) Field of Classification Search ..... 399/320, 399/328, 329, 330, 331, 333; 219/216
See application file for complete search history.

(56) References Cited

U.S. PATENT DOCUMENTS 5,689,788 A * 11/1997 Moser ..... 399/328
7,343,131 B2 * 3/2008 Nakajima ..... 399/333

FOREIGN PATENT DOCUMENTS

JP A 3-193161 8/1991
JP A 2000-137406 5/2000

* cited by examiner

*Primary Examiner*—Hoang Ngo
(74) *Attorney, Agent, or Firm*—Oliff & Berridge, PLC

(57) ABSTRACT

A fixing member including: a substantially cylindrical support and one or more layers provided on or above the support, including a surface layer that constitutes the outermost surface, the fixing member having: a difference in the width direction of the support between the maximum value and minimum value of the total thickness of the support together with all the layers provided on or above the support being approximately 50 μm or less; the surface layer consisting of a seamless member comprising a fluorine-containing solid material, the composition of the fluorine-containing solid material varying in the width direction of the support; the average thickness of the surface layer being in the range of approximately 20 μm to approximately 50 μm; a difference in the width direction of the support between the maximum value and minimum value of the thickness of the surface layer being approximately 5 μm or less; and the dynamic friction coefficient on the surface of the surface layer at 120° C. varying in the width direction of the support.

21 Claims, 16 Drawing Sheets

FIXING MEMBER, FIXING DEVICE AND IMAGE FORMING APPARATUS

CROSS-REFERENCE TO RELATED APPLICATION

This application is based on and claims priority under 35 USC 119 from Japanese Patent Application No. 2006-305161 filed on Nov. 10, 2006.

BACKGROUND

1. Technical Field

The invention relates to a fixing member, a fixing device and an image forming apparatus.

2. Related Art

When an image is formed by an electrophotographic system, a crease of a recording paper sheet having an image formed thereon may occur due to a fixing device equipped with at least a pair of fixing members placed in an image forming apparatus and positioned to be opposite to each other so as to form a contact portion thereof. In order to prevent this paper crease, various methods have been proposed.

In a case of a fixing device using rolls as fixing members, for example, a method is known in which the fixing roll has such a shape that the outer diameter in the axial direction is bigger when the position thereof is closer to the both ends of the fixing member, while it is smaller when the position thereof is closer to the center of the fixing member, (hereinafter, this shape may be referred to as "flare shape").

In the above method, the speed of delivering a recording paper sheet at the edge part of the recording paper sheet becomes higher than that at the center of the paper sheet, when the recording paper sheet is delivered by rotation of the fixing rolls. Accordingly, the recording paper sheet is delivered in such a manner that the paper sheet is pulled from the both sides thereof in the delivery direction, thereby preventing the paper sheet from being creased.

A method is also known in which the pressure at the contact portion formed by a pair of fixing members is adjusted so as to be higher at the both ends and lower at the center. When both of the fixing members are roll-type fixing members, distribution of the pressure at the contact part can be controlled by the outer diameter (shape) of the rolls, and when one of the fixing members is a belt-type fixing member, distribution of the pressure can be controlled by the shape of a pressing member (pad) that presses the belt to the other roll-type fixing member.

In this method, the speed of delivering the recording paper sheet at the both edge parts becomes higher than that at the center, similarly to the case described above, and the recording paper sheet is delivered while being pulled from the both sides, thereby preventing the paper sheet from being creased.

SUMMARY

According to an aspect of the invention, there is provided a fixing member comprising: a substantially cylindrical support and one or more layers provided on or above the support, including a surface layer that constitutes the outermost surface, the fixing member having:

a difference in the width direction of the support between the maximum value and minimum value of the total thickness of the support together with all the layers provided on or above the support being approximately 50 μm or less;

the surface layer consisting of a seamless member comprising a fluorine-containing solid material, the composition of the fluorine-containing solid material varying in the width direction of the support;

the average thickness of the surface layer being in the range of approximately 20 μm to approximately 50 μm;

a difference in the width direction of the support between the maximum value and minimum value of the thickness of the surface layer being approximately 5 μm or less; and the dynamic friction coefficient on the surface of the surface layer at 120° C. varying in the width direction of the support.

BRIEF DESCRIPTION OF THE DRAWINGS

Exemplary embodiments of the present invention will be described in detail based on the following figures, wherein.

DETAILED DESCRIPTION

Figure 1:
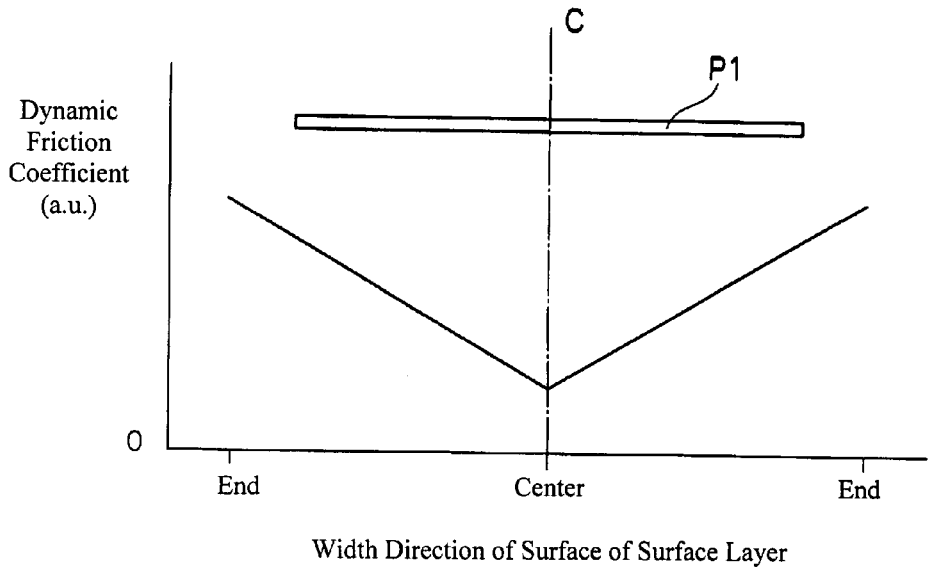
FIG. 1 is a graph showing an example of a profile of variation in the dynamic friction coefficient in the width direction on the surface of a surface layer of the fixing member of the invention.

A first embodiment of the fixing member of the invention includes a cylindrical support, and on the support one or more layers including a surface layer that constitutes an outermost surface of the support, wherein the difference between the maximum and minimum values of the total thickness of the support and all of the layers formed on the support, in the width direction of the support, is 50 μm or less; the surface layer consists of a seamless member composed of a fluorine-containing solid material; the composition of the fluorine-containing solid material varies in the width direction of the support (hereinafter referred to as "width direction", or "axial direction" when the fixing member is roll-type, sometimes); the average thickness of the surface layer is in the range of 20 μm or more and 50 μm or less; the difference in the width direction of the support between the maximum and minimum values of the thickness of the surface layer is 5 μm or less; and the dynamic friction coefficient at the surface of the surface layer at 120° C. varies in the width direction of the support.

The fixing member of the first embodiment can be easily produced and the structure of a fixing device including the fixing member can be simplified, and a paper sheet can be stably prevented from being creased without generating image defects even when images are formed over a long period of time. The above effects can be achieved for the reasons as below.

As a first method of preventing paper crease, there is a method in which a fixing roll is formed into a flare shape, i.e., the outer diameter of the fixing roll becomes smaller from the both ends toward the center, in the axial direction. However, in the production of the fixing roll used in this method, a mold is used to regulate the shape of the roll in the axial direction so as to be flare-shaped. Therefore, only a fixing roll having a flare shape that is releasable from a mold can be produced.

Additionally, the production yield of such a flare-shaped fixing roll is low, as compared with a case of molding a so-called straight-shaped fixing roll having an outer diameter being constant in the axial direction, due to high incidence of scratches at the time of releasing the roll from a mold. Further, the unit cost of the mold is also high, since the mold for the production of a flare-shaped fixing roll itself requires highly delicate shape regulation as compared with the mold for the production of a straight-shaped fixing roll.

On the other hand, the fixing member of the first embodiment prevents paper crease by grading the friction coefficient in the width direction by varying the composition of the fluorine-containing solid material contained in the surface layer in the width direction. The surface layer having this gradual composition structure is formed utilizing an ink jet method described later. In addition, the fixing member of the invention has a thickness profile in the width direction of a substantially linear shape similar to the non-flare shape (so-called straight shape) of the common fixing members that are conventionally used, i.e., the difference in the width direction between the maximum value and minimum value of the total thickness of the support together with all the layers disposed thereon or above is 50 μm or less. Accordingly, there is no need to use a flare-shaped mold to produce a fixing member, and scratching due to the use of a flare-shaped mold does not occur.

A second method of preventing paper crease includes a method of regulating the pressure distribution at the contact portion. In this method, the pressure applied onto the center and the pressure applied onto the both ends are required to be regulated so as to be different from each other, at the time of assembling the fixing apparatus.

When the pressure distribution is regulated by the outer diameter (shape) of the fixing roll, biased abrasion is generated with time due to difference between the pressures applied onto the center and the both ends of the fixing roll, and a paper sheet becomes more likely to be creased. Additionally, it is not easy to regulate the pressure applied onto the center of the contact portion and the pressure applied onto the both ends in the width direction so as to be different from each other in a uniform manner, which makes the assembling of the fixing device also difficult.

Further, although the fixing roll usually consists of an elastic layer and/or a release layer, and a metallic support (so-called core bar) onto which the layers are formed, the elastic layer has recently become thinner in order to meet the reduction in the warm-up time (the period from the point of time when an image forming apparatus is powered up to the point of time when a fixing device is heated to a temperature at which fixing can be performed). Accordingly, the fixing roll having varied outer diameter in the width direction has become less suitable for regulating of the pressure distribution at the contact portion by means of elastic deformation of the fixing roll, and a paper sheet may not be prevented from being creased in some cases.

In addition, when one of a pair of the fixing members is a belt-type fixing member, the pressure distribution is regulated by the shape of a pressing member (pad) for pressing the belt against the other roll-type fixing member. In such a case, a highly precisely processed pad is required to obtain the desired pressure distribution. However, variation in the accuracy of the shape among pads has the tendency of significantly influencing the pressure distribution at the contact portion, which may cause variation in the performance of paper crease-prevention among the fixing devices.

Further, as compared with the cases where the fixing device is assembled using straight-shaped fixing rolls so that the pressure distribution at the contact portion is substantially uniform (the difference in the width direction between the maximum and minimum values in the suppress strength at the pressure contact portion is within 5%), there is also a tendency of causing variation in the performance of paper crease-prevention among the fixing devices when a fixing roll having a graded outer diameter (shape) in the axial direction as described above is used, or when a fixing device in which a belt-type fixing member is pressed against a roll-type fixing member by a pad is assembled due to a variation between the pressure applied onto the center of the contact portion and the pressure applied onto the both ends caused by a subtle difference in the size of the fixing members (including a pad if it is used) or a subtle difference in the position of the members to be combined.

On the other hand, the fixing member in the first embodiment suppresses paper crease by means of the difference in the width direction of the support in friction coefficient of the surface layer. Therefore, there is no need to intentionally adjust the pressure applied onto the center of the contact portion and the pressure applied onto the both ends so as to be different from each other.

That is, a fixing device including a fixing member of the first embodiment and a fixing portion arranged to form a contact portion with the fixing member can obtain a pressure distribution in the width direction at the contact portion that is similar to that of the fixing device using a straight-shaped fixing roll.

A third method of preventing paper crease includes a method of applying silicone oil via a web onto a fixing member such that the amount of the oil in the width direction of the fixing member at the center is different from that at the both ends. In this method, the friction coefficient is regulated by the amount of the oil supplied onto each of the center and the both ends. However, the friction coefficient at the center and at the both ends has a tendency to change with time from the beginning, since the oil gradually migrates in the width direction of the fixing member. Therefore, stable effect of preventing paper crease cannot be obtained over a long period of time. Further, the structure of the fixing device becomes complicated due to the use of a web.

Further, as an additional adverse effect caused by the use of oil, there is also a problem of forming an image with uneven gloss. This problem is attributed to a difference in glossiness on the image caused by a difference between the amounts of oil at the center and at the both ends of the fixing member.

In addition, there is also a problem of difficulty in regulating the amount of oil supplied onto the fixing member in the width direction. This is because the amount of oil eventually becomes uniform with time, when a single web is used, event though the amount of the oil impregnated into the web is made different along the width direction of the fixing member. In order to overcome this problem, a method could be applied in which plural webs having different impregnating amount of the oil. However, if an opening is formed between the two adjacent webs, this opening may cause an image defect of uneven glossiness on the image.

On the other hand, the fixing member in the first embodiment prevents paper crease by changing the friction coefficient on the surface layer in the width direction of the support. In this respect, the first embodiment has an idea in common with the method of applying silicone oil onto a fixing member using a web such that the amounts thereof at the center and at the both ends in the width direction of the fixing member are different.

However, the fixing member in the first embodiment has a surface layer that constitutes the outermost surface of the fixing member that is composed of a fluorine-containing solid material, and the composition of the fluorine-containing solid material varies in the width direction as the friction coefficient on the surface of the surface layer varies in the width direction. Therefore, there is no need of applying or impregnating a liquid lubricant such as silicone oil to regulate the friction coefficient.

In addition to the method of using an oil as described above, other methods of changing the friction coefficient on the outermost surface of the fixing member in the width direction can also be considered as the general methods, and examples of such methods include: (1) a method of patching sheet materials having different friction coefficient to form a surface layer; (2) a method of giving a surface layer entirely composed of a single material to different surface treatments in the width direction; and (3) a method of utilizing two or more kinds of coating solutions having different composition by dipping coating or spray coating, the solutions being capable of imparting different friction coefficients onto a surface layer after being dried and solidified.

In the case of the method described in (1) above, a seam joint formed by patching the sheets may cause a striated defect upon at the time of forming an image. Further, peeling or breaking at the seam joint tends to occur, thereby causing luck of durability that makes the method less practicable. On the other hand, the fixing member of the first embodiment, the surface layer of which being composed of a seamless member, can avoid the above-discussed problem. The surface layer composed of a seamless member can be easily formed by an ink jet method described later.

In the case of the method described in (2) above, the effect of the surface treatment rapidly disappears even if the surface layer is only slightly worn away as the paper sheets pass through at the time of forming an image. Accordingly, the effect of preventing paper crease cannot be maintained over a long period, thus making the method less practicable. Further, the surface treatment inhibits the self-releasability of a fluorine material, thereby reducing releasability of toners at the surface-treated portion, and causing an image defect called offset on a fixed image. The fixing member of the first embodiment, however, prevents paper crease over a prolonged period of time by means of the variation in the composition of the fluorine-containing solid material in the width direction that varies the friction coefficient on the surface of the surface layer in the width direction, and the surface layer being as thick as 20 μm or more. Further, the variation in the composition of the fluorine-containing solid material is obtained without deteriorating the self-releasability of the material. The releasability of toners is not deteriorated either, which ensures favorable fixability of the image.

The method described in (3) above also lucks in practicality, since a significant degree of surface unevenness which causes streaked defects on the images is inevitably generated.

In the dipping coating method, for example, when using two different coating solutions to apply a specified coating solution onto only a predetermined region in the width direction, there is a need to cover a region which has already been coated with a coating solution with a masking member. However, generation of the difference in the coating thicknesses or unevenness thereof, in the regions covered or not covered with the masking member, is not avoidable, which makes the method little practical.

In the spray coating method, on the other hand, there is no need to use a masking member by applying, for example, a method of simultaneously spraying two kinds of coating solutions having different composition. However, it is not virtually possible to handle delicate control of simultaneously applying two kinds of coating solutions, while changing the coating ratio thereof in the width direction of the member, by a method such as spray coating that requires air pressure at a certain level or more for application. In the case where the pressure for application is changed, the drying speed of the applied coating solution varies, thereby making it difficult to form a coating film where the two kinds of coating solutions are uniformly mixed. In addition, the thickness of the coating becomes significantly uneven, particularly in the width direction of the surface layer, which may cause image defects (line defects in the images).

The fixing member of the first embodiment, however, does not have a surface unevenness that causes striated defects in the images, since the surface layer is formed by an ink jet method to be described later, a coating film can be formed from the uniformly mixed coating solution even when two or more thereof are used, and the difference in the width direction between the maximum value and the minimum value of the thickness of the surface layer can be suppressed to 5 μm or less.

Now, the fixing member of the first embodiment is described in more detail.

The layer structure of the fixing member of the first embodiment is not particularly limited insofar as the fixing member has a cylindrical support and one or more layers including a surface layer constituting the outermost surface, the layers being arranged on the support. However, when the fixing member is in the form of a roll or seamless belt, the fixing member particularly preferably includes a cylindrical support, an elastic layer disposed onto the outer periphery of the cylindrical support, and a release layer disposed onto the outer periphery of the elastic layer. In this case, the release layer constitutes the surface layer. The release layer in the invention has a surface having releasability from toners, and includes a fluorine-containing solid material such as fluorine resin or fluorine rubber. The elastic layer means a layer at least being capable of elastic deformation and usually contains an elastic material.

When there is only one layer (only a surface layer) is disposed onto the outer periphery of the support, it is particularly preferable that the surface layer functions at least as a release layer, and further functions as an elastic layer. The following descriptions are on the premise that the layers disposed onto the outer periphery of the support include an elastic layer and a release layer, wherein the surface layer means a release layer, unless otherwise specified. However, the layer structure of the fixing member of the invention is not limited thereto.

In the fixing member in the first embodiment, the difference between the maximum and minimum values of the total thickness of a support and all layers disposed onto the support (hereinafter referred to sometimes as "total thickness unevenness") is 50 μm or less, preferably 30 μm or less, and more preferably 20 μm or less.

When the total thickness unevenness is greater than 50 μm, the pressure distribution in the width direction at the contact portion in a fixing device using the fixing member of the first embodiment may become uneven and the fixing member may be unevenly abraded. Depending on the position at which the thickness unevenness occurs, the paper crease-preventing effect may not be obtained in some cases.

The total thickness unevenness is determined by measuring the total thickness at two positions, at which the fixing member is equally divided into two in the circumferential direction, each of the two positions including three sites, at which the fixing member is equally divided in the width direction into four, thus at six sites in total. The total thickness unevenness is then determined as the difference between the maximum value and the minimum value of the six measurement sites. The total thickness at the respective measurement sites is determined by observing a cross-section surface of the fixing member by an optical microscope.

The surface layer is formed by a seamless member composed of a fluorine-containing solid material, and the composition of the fluorine-containing solid material varies in the width direction of the support.

As the fluorine-containing solid material, known fluorine resins and fluorine rubbers can be used, and among which a tetrafluoroethylene/perfluoroalkyl vinyl ether copolymer, which is a copolymer of tetrafluoroethylene and perfluoroalkyl vinyl ether, is particularly preferably used. If necessary, other additives may also be contained. Details of these materials will be described later.

The expression "the composition of the fluorine-containing solid material varies in the width direction of the support" essentially means that the compounding ratio of a material constituting the surface layer varies in the width direction. However, when a polymer such as a fluorine resin is used as the fluorine-containing solid material, the above expression is also applied to the cases where the degree of polymerization (weight-average molecular weight) in the width direction of the surface layer is varied, even though the molecular structure of the repeating unit is homogenous.

The method of varying the composition of a material constituting the surface layer in the width direction of the surface layer can be selected in consideration of the material constituting the surface layer and a profile of the dynamic friction coefficient in the width direction on the surface of the surface layer at 120° C. From the viewpoint of regulating the composition, the method of regulating the dynamic friction coefficient on the surface of the surface layer at 120° C. is not particularly limited, but there is a method of regulating physical values such as coefficient of elasticity, crystallinity and melting point, by controlling the composition of the fluorine-containing solid material. Details of the method of regulating the dynamic friction coefficient by changing the composition of the fluorine-containing solid material will be described later.

The fixing member of the first embodiment has an average thickness of the surface layer being 20 μm or more, preferably 25 μm or more, and more preferably 30 μm or more. When the average thickness of the surface layer is less than 20 μm, an effect of preventing paper crease over a long period of time may not be maintained.

The upper limit of the average thickness of the surface layer is 50 μm or less, preferably 45 μm or less, and more preferably 40 μm or less. When the average thickness of the surface layer is greater than 50 μm, in the case of a fixing member provided with an elastic layer between the surface layer (release layer) and the support, the surface of the fixing member may become so hard that the image quality may be deteriorated.

The difference in the width direction between the maximum value and the minimum value of the thickness of the surface layer (hereinafter referred to sometimes as "thickness unevenness of the surface layer") of the support is 5 μm or less, preferably 3 μm or less, and more preferably 2 μm or less. When the thickness unevenness of the surface layer is greater than 5 μm, striated defects may occur in the images.

The average thickness of the surface layer is determined by measuring the total thickness at two positions, at which the fixing member is equally divided into two in the circumferential direction, each of the two positions including three sites in the width direction, at which the fixing member is equally divided in the width direction into four, thus at six sites in total. The average thickness of the fixing member is determined as the average value of the thicknesses at the six sites.

The thickness unevenness of the surface layer is determined by measuring the thickness of the surface layer at two positions, at which the fixing member is equally divided into two in the circumferential direction, each of the two positions including nine sites in the width direction, at which the fixing member is equally divided in the width direction into ten, thus at eighteen sites in total. The thickness unevenness of the surface layer is determined as the difference between the maximum value and minimum the value among the above eighteen measurement sites. The thickness of the surface layer at each measurement site is determined by measuring by a laser focus microscope.

The difference in the width direction between the maximum value and minimum value of the surface roughness (central line average roughness; Ra) of the surface layer (hereinafter referred to sometimes as "surface roughness unevenness") is preferably 0.2 μm or less, and more preferably 0.1 μm or less. When the surface roughness unevenness is greater than 0.2 μm, the glossiness of an image may become uneven.

The surface roughness unevenness is determined by measuring the surface roughness at two positions in the circumferential direction, each of the two positions including nine sites in the width direction, at which the fixing member is equally divided in the width direction into ten, thus at eighteen sites in total. The surface roughness unevenness of the surface layer is determined as the difference between the maximum value and minimum the value among the above eighteen measurement sites.

The surface roughness (center line average roughness Ra) at each measurement site can be measured by a method stipulated in JIS B0601-1994, the content of which is incorporated by reference herein. Specifically, a sample is measured at a measurement length of 2.5 mm by a contact-type surface roughness measuring instrument SURFCOM 1400A (manufactured by TOKYO SEIMITSU Co., Ltd.). For example, the measurement is conducted under the measurement conditions of measurement length Ln=2.5 mm, standard length L=0.8 mm and cutoff value of 0.8 mm, at each measurement site.

In the fixing member of the first embodiment, the dynamic friction coefficient on the surface of the surface layer at 120° C. (hereinafter, sometimes simply referred to as "the dynamic friction coefficient") varies in its value in the width direction of the support.

The profile of the variation in the dynamic friction coefficient in the width direction is not particularly limited as long as the profile is capable of preventing paper crease. However, the difference in the width direction between the maximum value and the minimum value of the dynamic friction coefficient ($\Delta\mu$) needs to be at least 0.03, since any types of profile cannot prevent paper crease when $\Delta\mu$ is too small.

The expression "the profile of the variation in dynamic friction coefficient in the width direction is a profile capable of preventing paper crease" refers to a profile in which the dynamic friction coefficient increases toward the both ends, starting from the point of the surface layer that corresponds to the center line of a recording medium passing through a contact portion formed by a pair of fixing members. The center line is defined as a line parallel to the direction in which the recording medium is delivered, and as a line equally dividing the recording medium into two parts in a direction perpendicular to the delivery direction of the recording medium.

However, in ordinary practice at the time of fixing, a recording medium passes through the contact portion in such a manner that the center (center in the width direction of the surface layer) of the contact portion formed by a pair of fixing members, wherein at least one of the fixing members is composed of the fixing member of the invention, corresponds with the central line of the recording medium passing through the contact portion (the central line is defined as a line parallel to the direction in which the recording medium is delivered, wherein the line equally divides the recording medium into two parts in a direction perpendicular to the delivery direction of the recording medium).

Accordingly, it is particularly preferable that the fixing member has a profile of the variation in the dynamic friction coefficient that increases from the center toward the two ends of the surface of the surface layer (hereinafter, referred to sometimes as "increasing profile") or a profile in which the dynamic friction coefficient decreases from the center toward the both ends (hereinafter, referred to sometimes as "decreasing profile"), on the premise that the fixing member is utilized in the embodiment described above.

The expression "increases (or decreases) from the center toward the two ends" includes not only a trend in which the dynamic friction coefficient uniformly increases (or decreases) but also a trend in which the dynamic friction coefficient increases (or decreases) as a whole with repeated up and downs.

Whether the dynamic friction coefficient increases (or decreases) as a whole or not can be determined by observing whether the dynamic friction coefficient increases (or decreases) in a linear manner or not, when dividing the actual profile of the dynamic friction coefficient in half and approximating each variation in the dynamic friction coefficient starting from the center toward each end by a straight line.

The phrase "uniformly increase (or decrease) from the center toward the two ends" means the situation that the dynamic friction coefficient continuously increases (or decreases) without decreasing (or increasing) at a certain range of the section in the width direction, or the situation that the dynamic friction coefficient continuously increases (or decreases) at a certain range of the section, even when the value of the dynamic friction coefficient in the width direction remains constant at the other section.

Which one of the increasing and decreasing profiles should be selected for preventing paper crease is determined depending on which one of a fixing member directly driven by a driving source such as a motor (a fixing member at the driving side) or a fixing member driven by the fixing member at the driving side (a fixing member at the driven side) is the fixing member of the invention.

That is, when the fixing member of the first embodiment is used as a fixing member at the driving side, the increasing profile is selected. In this case, a greater degree of minute sliding is generated on a contact surface between the surface of a recording medium passing through a contact portion and the surface of the surface layer at the time of fixation at the side of the central line, as compared with the one generated at the side of the both ends of the recording medium. Accordingly, the delivery speed at the both ends is higher than the delivery speed at the side of the central line, and the force to stretch the recording medium toward the both sides in the delivery direction acts on the recording medium to prevent paper crease.

On the other hand, when the fixing member of the first embodiment is used as a fixing member at the driven side, the decreasing profile is selected. In this case, the friction coefficient at the side of the center of the fixing member at the driven side is relatively greater than the one at the both ends. At the time of fixation, therefore, an effect of diminishing the delivery speed is generated at the side of the central line of the recording medium on the contact surface between the surface of the recording medium passing through a contact portion and the surface of the fixing member at the driving side placed opposite the fixing member at the driven side. Accordingly, the delivery speed at the both ends is higher than the delivery speed at the side of the central line of the recording medium, and thus the force to stretch the recording medium towards the both sides in the delivery direction acts on the recording medium to prevent paper crease.

When the fixing member of the first embodiment is used only as the one of a pair of fixing members constituting the fixing device, a fixing member is used as the other fixing member than the fixing member of the first embodiment, whose surface has a substantially constant dynamic friction coefficient in the width direction (the difference ($\Delta\mu$) between the maximum value and minimum value of the dynamic friction coefficient in the width direction is 0.01 or less), and conventionally known fixing members can be utilized for this fixing member.

The following description is made on the premise that only one of a pair of fixing members constituting the fixing device is the fixing member of the first embodiment, and the other fixing member is a fixing member whose surface has a substantially constant dynamic friction coefficient in the width direction, unless otherwise specified. However, the invention is not limited to this constitution.

The measurement of dynamic friction coefficient at 120° C. in the first embodiment is conducted with a friction coefficient measuring instrument (trade name: Friction Player FPR-2000 manufactured by Rhesca Co., Ltd.) by using, as a measurement sample, a surface layer sample cut out from a fixing member that has been manufactured, or a surface layer sample formed onto a support such as a polyimide film under the same conditions as that for the formation of the surface layer of the fixing member.

In the measurement, the measurement sample is fixed onto a head having the size of 5×5 mm, a paper sheet (trade name: P paper, manufactured by Fuji Xerox Co., Ltd.) is stick as a recording medium onto the side of a rotating stage, and the surface of the rotating stage is heated to 120° C. In this state, the head is pressed against the recording medium under load of 200 g and is rubbed against the recording medium at a speed of 200 mm/sec for 10 seconds, at which the dynamic friction coefficient is measured.

FIG. 1 is a graph showing one example of a profile of the variation in dynamic friction coefficient in the width direction of the fixing member of the first embodiment of the surface of the surface layer, wherein the horizontal axis indicates the width direction of the surface of the surface layer and the vertical axis indicates the dynamic friction coefficient. In FIG. 1, the symbol P1 indicates the size of the recording medium passing through the contact portion and the position at which the contact portion passes (the length in the width direction of the surface of the surface layer and the contact position of the recording medium in the width direction of the surface of the surface layer). The dashed-dotted line indicated by the letter C indicates the central line of the recording medium (the central point of the length of the surface of the surface layer in the width direction). In the example shown in FIG. 1, it is indicated that the recording layer passes through the contact portion such that the center line C of the recording medium and the center of the surface of the surface layer correspond with each other.

FIG. 1 shows one example of the increasing profile wherein the dynamic friction coefficient uniformly increases from the center toward the both ends. Accordingly, by using a fixing member having the increasing profile shown in FIG. 1 as the fixing member at the driving side in a fixing device, paper crease can be prevented. In the increasing profile shown in FIG. 1, the dynamic friction coefficient increases in a linear manner from the center toward the both ends, but it may also increase in a manner to draw a curve such as a quadratic curve.

When the graph shown in FIG. 1 is a profile of a reverse case (decreasing profile) in a direction of the vertical axis, paper crease can be prevented by using a fixing member having this profile of dynamic friction coefficient as the fixing member at the driven side in the fixing device.

Figure 2:
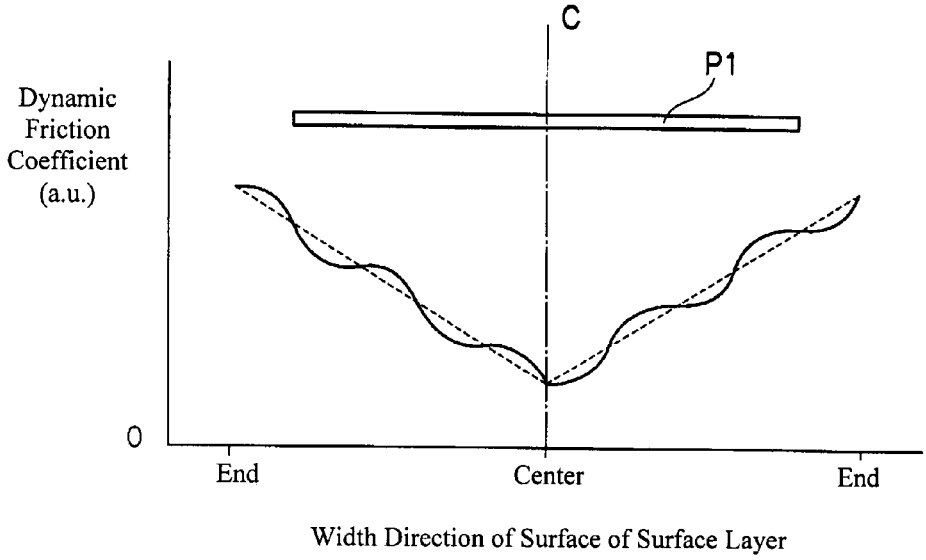
FIG. 2 is a graph showing another example of a profile of variation in the dynamic friction coefficient in the width direction on the surface of a surface layer of the fixing member of the invention.

FIG. 2 is a graph showing another example of a profile of the variation in dynamic friction coefficient in the width direction of the surface of the surface layer of the fixing member in the first embodiment. In FIG. 2, the width direction of the surface of the surface layer is indicated by the horizontal axis and the dynamic friction coefficient by the vertical axis. In FIG. 2, the solid line indicates an actual profile of the dynamic friction coefficient, and the dashed line indicates a profile of the dynamic friction coefficient obtained by approximating the above profile indicated by the solid line by a straight line. The symbols P1 and C have the same meanings as the ones used in FIG. 1.

FIG. 2 shows one example of the increasing profile (indicated by the solid line) in which the dynamic friction coefficient repeats up and downs in a short cycle, but increases (or decreases) as a whole. The profile obtained by approximating this profile of the dynamic friction coefficient by a straight line (i.e., the profile shown by the dashed line) exhibits the same profile as the one shown in FIG. 1. Accordingly, paper crease can be prevented by using a fixing member having the increasing profile as shown in FIG. 2 as the fixing member at the driving side in the fixing device.

Figure 3:
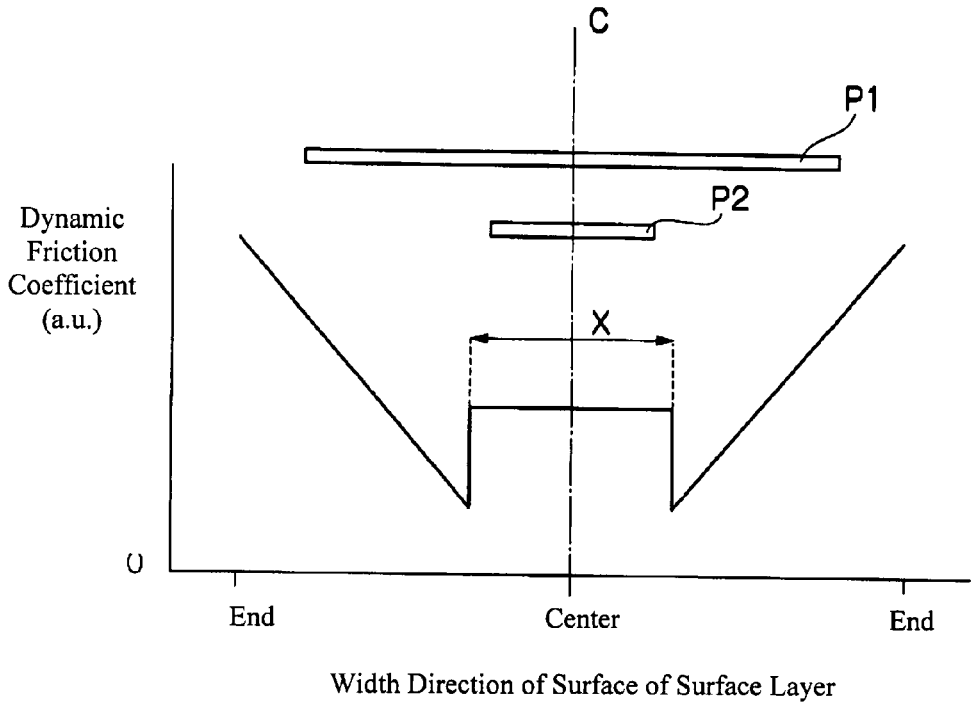
FIG. 3 is a graph showing another example of a profile of variation in the dynamic friction coefficient in the width direction on the surface of a surface layer of the fixing member of the invention.

FIG. 3 is a graph showing another example of the profile of the variation in dynamic friction coefficient in the width direction of the surface of the surface layer in the fixing member in the first embodiment. The width direction of the surface of the surface layer is indicated by the horizontal axis and the dynamic friction coefficient by the vertical axis. The symbols P1 and C have the same meanings as the ones shown in FIG. 1, and the symbol P2 shows the size of the recording medium passing through the contact portion and the position at which the contact portion passes through (the length in the width direction of the surface of the surface layer and the contact position of the recording medium in the width direction of the surface of the surface layer). In FIG. 3, the length of the surface of the surface layer in the width direction of the recording medium P2 is assumed to be in the range of about ½ to ⅕ of the recording medium P1. The width indicated by X in FIG. 3 is somewhat larger than the length of the surface of the surface layer in the width direction of the recording medium P2 (the width shown by X is in the range of 1.05- to 1.2-times based on the width of the recording medium P2).

FIG. 3 shows an example wherein the dynamic friction coefficient basically increases as a whole from the center toward the both ends, but the dynamic friction coefficient at the region in the vicinity of the center (the region shown by X in the figure) is lower than the ones at the both ends, even though it is somewhat higher than the one at the outer side of the region in the vicinity of the center. That is, FIG. 3 shows a profile in which the dynamic friction coefficient remains constant at the region in the vicinity of the center in the width direction, then drops down once to the minimum value at the outside of the region in the vicinity of the center, and again increases therefrom in a linear manner toward the both ends.

In the profile of the dynamic friction coefficient shown in FIG. 3, the force to stretch the recording medium P1 toward the both sides in the delivery direction acts on the recording medium P1, but the friction coefficient at the region (region shown by X) through which the recording medium P2 passes remains constant in the width direction. Therefore, the force to stretch the recording medium P2 toward the both sides in the delivery direction does not act on the recording medium P2. Accordingly, the force to prevent paper crease acts on the recording medium P1, whereas the force to prevent paper crease does not act on the recording medium P2.

As shown above, the fixing member of the first embodiment may have a profile of dynamic friction coefficient wherein the force to prevent paper crease selectively acts on a recording medium of a specified size, as is the case of FIG. 3.

For example, when the recording medium P1 is a recording medium susceptible to paper crease such as a paper sheet of A4 or A3 size, while the recording medium P2 is a recording medium being small in size and having resistance to paper crease such as a postcard paper, a fixing member having the profile of dynamic friction coefficient illustrated in FIG. 3 can be utilized.

There may be the cases where paper crease cannot be prevented due to the absence of the forth to stretch the recording medium toward the both sides in the delivery direction, when the degree of the variation in dynamic friction coefficient in the width direction is relatively low against the size of the recording medium passing through the contact portion, regardless of whether the profile of the variation in dynamic friction coefficient in the width direction of the surface of the surface layer is increasing or decreasing.

The size in the width direction of the fixing member used in the fixing device also depends on whether an image forming apparatus equipped with the fixing device is a large machine generally for use in an office or the like where A3- or B5-size paper sheets are also printed in addition to A4-size paper sheets, or a small machine generally for use at home where postcard papers are also printed in addition to A4- or B5-size paper sheets.

In view of the above, in the case of a fixing member having a size capable of longitudinal feeding of a paper sheet of A3 and A3 enlarged size (329 mm×483 mm) at the maximum, i.e., the length of the surface layer in the width direction of the support is in the range of 320 mm or more and 360 mm or less, the difference between the dynamic friction coefficient at 120° C. at the center of the surface layer and the one at a position away from the center toward the both ends by 160 mm is preferably in the range of 0.03 or more and 0.19 or less.

When the above gap is smaller than 0.03, preventing of paper crease may be difficult, and when the above gap is greater than 0.19, partial adhesion of toners is highly likely to occur at a region having a relatively large dynamic friction coefficient in the width direction of the surface of the surface layer, thus deteriorating image quality in some cases.

In the case of a fixing member in a size capable of longitudinal feeding of an A4 paper sheet at the maximum, i.e., the length of the support in the width direction (the length of the surface layer in the width direction) is in the range of 220 mm to 250 mm, the difference between the dynamic friction coefficient at 120° C. at the center of the surface layer and the one at a position away from the center toward the both ends by 110 mm in the width direction of the surface layer is preferably in the range of 0.03 or more and 0.19 or less.

When the above gap is smaller than 0.03, preventing of paper crease may be difficult, and when the above gap is greater than 0.19, partial adhesion of toners is highly likely to occur at a region having a relatively large dynamic friction coefficient in the width direction of the surface of the surface layer, thus deteriorating image quality in some cases.

-Constituent Material for Fixing Member-

The material constituting each member in the fixing member of the first embodiment is now described in more detail according to the support, elastic layer and surface layer (release layer), respectively.

--Support-

When the fixing member of the first embodiment is a roll-type member (hereinafter referred to sometimes as "fixing roll"), known supports for a fixing roll can be used for a cylindrical support that constitute the fixing member, which can be selected from cylindrical tubes (cylindrical cores) composed of a metal having excellent electrical conductivity such as aluminum, copper or nickel, an alloy such as stainless steel or nickel alloy, ceramics, or the like. The thickness of the outer diameter or the wall thereof can be selected depending on the purposes. For example, the outer diameter can be determined on the basis of the desired width of a contact portion for use in the fixing device. Further, when the fixing roll is used as a heating member, for example, it is desired from the viewpoint of reduction in the warm-up time of the heating member that the wall thickness of the cylindrical core has a minimum thickness in such a range as to be durable to suppress the strength applied onto the contact portion when used in the fixing device.

In preparation of the fixing roll, the outer periphery of the support may be subjected to various surface treatments in order to improve adherence to a layer formed on the outer periphery of the support. The surface treatment is not particularly limited, and includes degreasing treatment with an organic solvent, surface roughening treatment with sand-blasting, primer treatment and the like.

When the fixing member in the first embodiment is an endless belt-type member (hereinafter referred to sometimes as "fixing belt" or "endless belt"), the fixing member may be composed of, for example, a polymer film, metal film, ceramics film, glass fiber film or a composite film obtained by combining two or more thereof, as long as the material has a strength suitable for training around a support roll or a pressing roll onto which the endless belt is stretched.

Examples of the polymer films include sheet- or cloth-type molded products of polyesters such as polyethylene terephthalate, polycarbonates, polyimides, fluorine-based polymers such as polyvinyl fluoride and polytetrafluoroethylene, polyamides such as nylon, polystyrenes, polyacryls, polyethylenes, polypropylenes, modified celluloses such as cellulose polyacetates, polysulfones, polyxylylenes and polyacetals. Further, polymer complex compounds can also be used, which obtained by laminating a general-purpose polymer sheet with a layer of a thermostable resin such as a fluorine-, silicone- or crosslinked polymer. Among these, an endless belt being composed of a thermostable resin is preferable.

The polymer film may form a composite with a thermostable layer made of metal, ceramics or the like. Thermal conductivity improving agent such as granular, acicular or fibrous type of carbon black, graphite, alumina, silicone, carbide, boron nitride may be added into the polymer film. Additives such as an electrical conductivity-imparting agent, antistatic agent, release agent and reinforcing agent may also be added or applied inside the polymer film or onto the surface thereof, as necessary.

In addition to the polymer film described above, it is possible to employ, for example, paper such as condenser paper, glassine paper or the like, ceramics film, cloth-shaped glass fiber film formed from glass fiber, and metal film such as stainless steel film, nickel film etc.

-Elastic Layer-

In the fixing member of the first embodiment, an elastic layer can also be disposed at the surface layer side of the support and at the support side of the surface layer, as necessary.

An elastic material constituting the elastic layer of the fixing roll or fixing belt can be exemplified by silicone rubber and fluorine rubber, and is preferably be selected from elastic materials having excellent electrical conductivity.

Usable silicone rubber can be exemplified by vinyl methyl silicone rubber, methyl silicone rubber, phenyl methyl silicone rubber, fluorosilicone rubber and the like. Usable fluorine rubber can be exemplified by vinylidene fluoride-based rubber, ethylene tetrafluoride/propylene-based rubber, ethylene tetrafluoride/perfluoromethyl vinyl ether rubber, phosphazene-based rubber, fluoropolyether, and other fluorine rubbers. These materials can be used alone, or two or more thereof may be used in combination.

In addition to the elastic materials described above, various kinds of inorganic or organic fillers can be used in the elastic layer.

Usable inorganic fillers can be exemplified by carbon black, titanium oxide, silica, silicon carbide, talc, mica, kaolin, iron oxide, calcium carbonate, calcium silicate, magnesium oxide, graphite, silicon nitride, boron nitride, iron oxide, aluminum oxide, magnesium carbonate. Usable organic fillers can be exemplified by polyimide, polyamide imide, polyether sulfone, polyphenylene sulfide. As a special elastic material, PTFE (polytetrafluoroethylene) can also be used as fluorine resin.

-Surface Layer (Release Layer)-

A surface layer is formed on the surface of a support or the surface of an intermediate layer formed on the support such as an elastic layer. When the elastic layer is formed, the surface layer functions as a release layer. Further, prior to the formation of the surface layer, a primer layer may also be applied onto the surface of a member onto which the surface layer is formed, in order to improve adhesion between the surface layer and a layer arranged on the surface layer at the side of the support.

Examples of the materials constituting the primer layer include primer 902YL (manufactured by Du Pont-Mitsui Fluorochemicals, Co., Ltd.), PRM067 (manufactured by Du Pont-Mitsui Fluorochemicals, Co., Ltd.), and the like. The thickness of the primer layer is preferably 0.05 μm or more and 2.0 μm or less, and more preferably 0.1 μm or more and 0.5 μm or less.

The surface layer is composed of a fluorine-containing solid material, which is exemplified by a fluorine-based material such as a fluorine resin and fluorine rubber, and other additives such as fillers may be contained therein as necessary. The surface layer preferably contains a fluorine resin as a main component (the content of the fluorine resin in the fluorine-containing solid material is in the range of 95% by weight or more and 100% by weight or less). Further, the fluorine resin is particularly preferably used when the fixing member has an elastic layer, since the fluorine resin is not an elastic material.

On the other hand, when the fixing member does not have an elastic layer, a fluorine resin can also be used for the surface layer as is the case with the fixing member having an elastic layer. However, a fluorine rubber is used more preferably.

As the fluorine resin, for example, a tetrafluoroethylene/perfluoroalkyl vinyl ether copolymer (hereinafter abbreviated sometimes as "PFA") is used. By regulating the copolymerization ratio of the two monomers used in copolymerization of PFA (tetrafluoroethylene and perfluoroalkyl vinyl ether), the profile of dynamic friction coefficient in the width direction of the surface layer can be regulated as desired. It is because the coefficient of elasticity of PFA decreases as the introduced amount of the perfluoroalkyl vinyl ether increases against the amount of the tetrafluoroethylene in copolymerization of PFA, and as a result, the softness of PFA as the material increases, thereby increasing the friction coefficient.

Specifically, by preparing two or more kinds of PFAs obtained by copolymerizing tetrahydrofluoroethylene with perfluoroalkyl vinyl ether with different copolymerizing ratios, and (1) in the region where the dynamic friction coefficient on the surface of the surface layer is desired to be relatively high in the width direction of the surface layer, the compounding ratio of the PFA having higher copolymerization ratio of perfluoroalkyl vinyl ether to that of tetrafluoroethylene is made higher than the compounding ratio of the PFA having lower copolymerization ratio of perfluoroalkyl vinyl ether to that of tetrafluoroethylene, and (2) in the region where the dynamic friction coefficient on the surface of the surface layer is desired to be relatively low in the width direction of the surface layer, the compounding ratio of the PFA having higher copolymerization ratio of perfluoroalkyl vinyl ether to that of tetrafluoroethylene is made lower than the compounding ratio of the PFA having lower copolymerization ratio of perfluoroalkyl vinyl ether to that of tetrafluoroethylene.

For example, when the dynamic friction coefficient is desired to increase uniformly from the center toward the both ends in the width direction of the surface of the surface layer, the compounding ratio of the PFA having higher copolymerization ratio of perfluoroalkyl vinyl ether to that of tetrafluoroethylene is increased against the compounding ratio of the PFA having lower copolymerization ratio of perfluoroalkyl vinyl ether to that of tetrafluoroethylene, in the direction from the center to the both ends. When the dynamic friction coefficient is desired to remain constant in a certain section in the width direction, the compounding ratio is kept constant at the corresponding section.

When the dynamic friction coefficient is desired to decrease uniformly from the center toward the both ends in the width direction of the surface of the surface layer, the compounding ratio of the PFA having higher copolymerization ratio of perfluoroalkyl vinyl ether to that of tetrafluoroethylene is decreased against the compounding ratio of the PFA having lower copolymerization ratio of perfluoroalkyl vinyl ether to that of tetrafluoroethylene, in the direction from the center to the both ends. When the dynamic friction coefficient is desired to remain constant in the width direction in a certain section, the compounding ratio is kept constant at the corresponding section.

In the former case of the above, a phenomenon is observed that the amount of oxygen atoms in the tetrafluoroethylene/perfluoroalkyl vinyl ether copolymer increases in the direction from the center toward the both ends of the surface layer in the width direction of the surface layer. In the latter case of the above, a phenomenon is observed that the amount of oxygen atoms in the tetrafluoroethylene/perfluoroalkyl vinyl ether copolymer decreases in the direction from the center toward the both ends of the surface layer in the width direction of the surface layer. It is also observed that when the dynamic friction coefficient is kept constant in a certain section in the width direction, the amount of oxygen atoms is also kept constant.

The variation in the amount of oxygen atoms in the state of being as a fixing member can be easily observed by known methods for elemental analysis using XPS (X-ray photoelectron spectroscopy) or the like. The amount of oxygen atoms is determined in such a manner that the measurement conditions are the same at each of the measurement points arranged in the width direction of the surface layer, in order to enable relative comparative judgment in the width direction of the surface layer. Accordingly, the amount of oxygen atoms may be either a relative value (for example, peak intensity obtained as raw observed data) or an absolute value (for example, atomic %) obtained by using a standard sample or the like. The variation range of the amount of oxygen atoms in the width direction of the surface layer is preferably in the range of 14% or more and 47% or less, more preferably in the range of 20% or more and 40% or less, still more preferably in the range of 24% or more and 35% or less, in terms of the minimum value of the amount of oxygen atoms relative to the maximum value of the amount of oxygen atoms being 100%, in the width direction of the surface layer. When the minimum value is less than 14%, a force that strongly pulls a paper sheet in a direction perpendicular to the delivery direction as the paper sheet passes through the contact portion may occur to cause a phenomenon of paper waving, while when the minimum value is greater than 47%, paper crease may not be prevented.

When PFA is used in the fluorine-containing solid material as a main component (the content of PFA in the fluorine-containing solid material is in the range of 95% by weight or more and 100% by weight or less), the proportion of perfluoroalkyl vinyl ether in the total amount of the two monomers used for copolymerization of PFA is not particularly limited, but the proportion of perfluoroalkyl vinyl ether in the total amount of the two monomers used for copolymerization of PFA is preferably in the range of 0.8 mol % or more and 5.8 mol % or less, more preferably in the range of 1.5 mol % or more and 4.9 mol % or less, in terms of molar ratio.

When the proportion of perfluoroalkyl vinyl ether in the total amount of the two monomers used for copolymerization is less than 0.8 mol %, the PFA may lose its flexibility and become hard and brittle, further increasing its viscosity upon melting. Therefore, smoothness of the surface of the surface layer may be deteriorated in some cases.

On the other hand, when the proportion of perfluoroalkyl vinyl ether in the total amount of the two monomers used for copolymerization is more than 5.8 mol %, the melting point of the resulting PFA may become too low and the heat resistance thereof to heating for fixation may become insufficient in some cases.

In view of the above, when two PFAs having different copolymerization ratios are used as the fluorine-containing solid material, and the dynamic friction coefficient in the width direction on the surface of the surface layer is varied by changing the mixing ratio of the two PFAs in the width direction on the surface layer, it is preferable that the proportions of the perfluoroalkyl vinyl ether in the two monomers used for copolymerization of the two PFAs are in the range described below.

In the PFA having higher copolymerization ratio of perfluoroalkyl vinyl ether to tetrafluoroethylene (hereinafter referred to sometimes as the first PFA) than that of the other PFA (hereinafter referred to sometimes as the second PFA), the proportion of perfluoroalkyl vinyl ether in the total amount of the two monomers used for copolymerization is preferably in the range of 3.0 mol % or more and 5.8 mol % or less, more preferably in the range of 3.5 mol % or more and 4.9 mol % or less, in terms of molar ratio.

When the above proportion of perfluoroalkyl vinyl ether is less than 3.0 mol %, the degree of variation in the dynamic friction coefficient in the width direction on the surface of the surface layer decreases even if the mixing ratios of the first PFA and the second PFA are different, and thus paper crease may not be prevented in some cases. When the above proportion of perfluoroalkyl vinyl ether is greater than 5.8 mol %, heat resistance may be deteriorated as described above.

In the second PFA having lower copolymerization ratio of perfluoroalkyl vinyl ether to tetrafluoroethylene than that of the first PFA, the proportion of perfluoroalkyl vinyl ether in the total amount of the two monomers used for copolymerization is preferably in the range of 0.8 mol % or more and 2.0 mol % or less, more preferably in the range of 1.0 mol % or more and 1.8 mol % or less, in terms of molar ratio.

When the above proportion of perfluoroalkyl vinyl ether is greater than 2.0 mol %, the degree of variation in the dynamic friction coefficient in the width direction on the surface of the surface layer decreases even if the mixing ratios of the first PFA and the second PFA are different, and thus paper crease may not be prevented in some cases. When the above proportion of perfluoroalkyl vinyl ether is less than 0.8 mol %, smoothness on the surface of the surface layer may be deteriorated as described above.

The methods of imparting variation in the dynamic friction coefficient in the width direction on the surface of the surface layer by using two kinds of PFAs having different copolymerization ratios as the fluorine-containing solid material includes not only the method of using two or more kinds of PFAs having different copolymerization ratios in the width direction of the surface layer and changing the mixing ratio thereof, but also a method of dividing the surface layer into plural regions in the width direction and gradually changing the copolymerization ratio of the PFA used for forming respective regions in the direction from the center to both ends, wherein a single type of the PFA is used to form each region.

The proportion of perfluoroalkyl vinyl ether in the total amount of the two monomers used for copolymerization can be measured by solid $^{19}$F-NMR and solid $^{13}$C-NMR.

Solid $^{19}$F-NMR measurement Measuring instrument: CMX300, manufactured by Chemagnetic, 5 mm probe Measurement method: depth 2 method (resonant frequency; 282.67 MHz) Measurement conditions: 90° Pulse 3.0 μs, bandwidth; 100 kHz, repeating time; 5 s Rotational speed: 8 kHz, accumulated frequency; 32 Measurement temperature: 240° C.

Solid $^{13}$C-NMR measurement Measuring instrument: CMX300, manufactured by Chemagnetic, 5 mm probe Measurement method: single pulse method (resonant frequency 75.5563 MHz) Rotational speed: 8 kHz, accumulated frequency; 800 Measurement temperature: 240° C.

When PFA is used to form a surface layer by an ink jet method described later, the PFA is dispersed in a solvent to prepare a PFA dispersion. The PFA dispersion usually contains a single type of PFA. The term "single type" means that the copolymerization ratio of the two monomers used for copolymerization of PFA is only one level.

In this case, it is preferable that the two kinds of PFA particles being different in average particle diameter are contained in the PFA dispersion, and specifically preferable that the PFA particles having an average particle diameter of 0.1 μm or more and 1 μm or less (first PFA particles) and the PFA particles having an average particle diameter of 3 μm or more and 7 μm or less (second PFA particles) are contained therein. The average particle diameter of the first PFA particles is more preferably 0.3 μm or more and 0.8 μm or less, and the average particle diameter of the second PFA particles is more preferably 4 μm or more and 6 μm or less.

When the average particle diameter of the first PFA particles is smaller than 0.1 μm, the PFA dispersion may be thickened to make it difficult to form the surface layer by an ink jet method, and when the average particle diameter is greater than 1 μm, the surface layer formed may become brittle.

When the average particle diameter of the second PFA particles is smaller than 3 μm, mud cracks may be formed on the surface layer formed, while when the average particle diameter is greater than 7 μm, the surface of the surface layer may be roughened to deteriorate the glossiness of an image formed by a fixing device provided with this fixing member.

In the first embodiment of the invention, the "average particle diameter" refers to a volume-average particle diameter unless otherwise specified. The volume-average particle diameter shown hereinafter can be measured by a laser Doppler heterodyne particle size distribution meter (MICROTRAC-UP A150, manufactured by Nikkiso Co., Ltd.). The volume-average particle diameter is specifically determined as a particle diameter corresponding to 50% accumulation in terms of the volume obtained by drawing a cumulative distribution from the particle diameter of smaller side.

The compounding ratio of the first PFA particles to the second PFA particles (first PFA particles/second PFA particles) by weight is preferably in the range of 25/75 to 85/15, more preferably in the range of 30/70 to 80/20.

When the above compounding ratio is smaller than 25/75, the surface of the surface layer may be roughened to deteriorate the glossiness of an image formed by a fixing device provided with this fixing member, and when the above compounding ratio is greater than 85/15, mud cracks may be generated.

In addition to the two types of the PFA particles described above, various additives such as fillers may be dispersed in the PFA dispersion, as necessary. As the solvent, usable ones include, for example, water and alcohols such as methanol, ethanol and i-propyl alcohol.

In addition to the fluorine-based material such as fluorine resin and fluorine rubber, various additives such as fillers may be contained if necessary in the surface layer.

The filler contained in the surface layer is preferably at least one selected from the group consisting of metal oxide particles, silicate minerals, carbon black, nitride compounds and mica.

Among these, it is more preferable that at least one filler is selected from the group consisting of $BaSO_4$, zeolite, silicon oxide, tin oxide, copper oxide, iron oxide, zirconium oxide, ITO (indium oxide doped with tin), silicon nitride, boron nitride, titanium nitride and mica, and still more preferable that at least one filler is selected from the group consisting of $BaSO_4$, zeolite and mica. $BaSO_4$ or zeolite is particularly preferable, and $BaSO_4$ is most preferable.

The compounding ratio of the filler is not particularly limited, but when a fluorine resin is used as the fluorine-based material, the compounding ratio thereof is preferably 1 part by weight or more and 30 parts by weight or less, more preferably 1 part by weight or more and 20 parts by weight or less, based on 100 pars by weight of the fluorine resin.

When the compounding ratio of the filler is smaller than 1 part by weight based on 100 parts by weight of fluorine resin, releasability of toners or a recording medium may become highly excellent due to a high degree of releasability of the fluorine resin, whereas abrasion resistance tends to be deteriorated, and thus abrasion or defects on the surface of the surface layer may easily occur to cause troubles in the fixing device in some cases.

On the other hand, when the compounding ratio of the filler is greater than 30 parts by weight based on 100 parts by weight of fluorine resin, the state of the filler being uniformly dispersed in the surface layer may hardly be obtained, unevenness in the thickness of the surface layer may be caused and the high degree of releasability of the fluorine resin may be deteriorated to cause toner offset. Further, the surface of the surface layer may be roughened, lowering the glossiness of an image formed thereon or causing the roughness in the image.

The average particle diameter of the filler is preferably 0.1 μm or more and 15 μm or less, and from the viewpoint of preventing generation of sharp protrusions on the surface layer, the average particle diameter of the filler is more preferably 1 μm or more and 10 μm or less, still more preferably 2 μm or more and 8 μm or less.

When the average particle diameter of the filer is smaller than 0.1 μm, it may become difficult to add and disperse the filler in a dispersion for forming of a surface layer used to form the surface layer by the ink jet method, since the surface area of the powder becomes large.

On the other hand, when the above average particle diameter of the filler is greater than 10 μm, the degree of surface roughness of the surface of the filler-containing surface layer may become too high in some cases. Further, when the above average particle diameter of the filler is greater than 15 μm, the filler having a large particle diameter may easily form sharp protrusions, which may stick in an image (when printed on both sides of a sheet) and result in generation of white-dotted image defects. Accordingly, when a filler having a particle diameter of greater than 15 μm is contained in the surface layer, the compounding ratio of the filler having a particle diameter of greater than 15 μm in the surface layer is preferably 5% by weight or less, and is more preferably 3% by weight or less.

Depending on the structure of the image forming apparatus, the surface of the fixing member used in a fixing device mounted in this apparatus may need to be imparted with conductive properties (surface resistivity of $1\times10^4\Omega$ or less). In this case, electroconductive particles (particles with a volume resistivity of $10^7\Omega$cm or less) can be used as the filler contained in the surface layer.

Examples of the electroconductive particles include the above-mentioned metal oxide particles, silicate minerals, carbon black, nitrogen compound and mica, and other particles of titan oxides and the like.

When electroconductive particles are used as the filler and a fluorine resin is used as the fluorine-based material, the amount of the electroconductive particles is preferably 1 part by weight or more and 10 parts by weight or less, based on 100 parts by weight of the fluorine resin used to form the surface layer, from the viewpoint of imparting conductive properties, securing releasability obtained by the fluorine resin or securing the dispersibility of the electroconductive particles.

-Method for Manufacturing of Fixing Member-

The method for manufacturing of the fixing member of the first embodiment will now be described.

The fixing member of the first embodiment is manufactured at least through a step of forming a coating film onto the outer periphery of a cylindrical support or a member composed of a cylindrical support and one or more layers other than a surface layer formed on the support. The formation of the coating film is performed by a liquid droplet discharging head having a nozzle face provided with two ore more nozzles that eject the liquid droplets, the nozzle face being arranged to face the outer periphery of the cylindrical support, and at least two types of dispersions of different compositions to form the surface layer are ejected from the nozzle face in such a manner that the liquid droplet discharging head relatively moves in at least one direction selected from the width direction and circumferential direction of the cylindrical support, wherein the total amount of all of the surface layer-forming dispersions to be ejected is kept constant, while the ratio of the ejecting amount of each dispersion is varied in the width direction of the cylindrical support.

In the above description, the expression "at least two types of dispersions of different compositions to form the surface layer" indicates the coating solutions that form the films having different dynamic friction coefficients on the surface thereof, when the films are formed using each of the coating solutions, respectively.

The expression "the ratio of the ejecting amount of each dispersion varies in the width direction of the cylindrical support" means that the ejected amount of the dispersion that forms a film having larger (or smaller) dynamic friction coefficient on the surface thereof, when used singly, increases (or decreases) in the direction from the center toward the both ends of the cylindrical support, relative to the ejected amount of the dispersion that forms a film having smaller (or larger) dynamic friction coefficient on the surface thereof.

The expression "the ejected amount of the dispersion increases (or decreases) in the direction from the center toward the both ends" includes the cases where the ejected amount of the dispersion increases (or decreases) from the center toward the both ends as a whole, while repeating up and downs. Whether the ejected amount of the dispersion "increases (or decreases) as a whole" can be determined by whether the ejected amount of the dispersion increases (or decreases) in a linear manner from the center toward the both ends, when a profile of the ejected amount of each dispersion is divided at the center into two sections, and approximated by a straight line, respectively.

Hereinafter, the method for manufacturing the fixing member of the first embodiment will be described in more detail.

First, a cylindrical support is prepared to form the surface layer thereon by an ink jet method.

The cylindrical support used in preparation of a fixing member having no elastic layer is composed of a support (cylindrical core) when a fixing roll is prepared as the fixing member. On the other hand, when a fixing belt is prepared as the fixing member, the cylindrical support is composed of a cylindrical tube and an endless belt-type support fixed onto the outer periphery of the cylindrical tube. The outer periphery of the support may be subjected to a degreasing treatment with an organic solvent as necessary, or may be subjected to a primer treatment prior to the subsequent processes. In a case where a cylindrical core is used, the outer periphery thereof may be subjected to a surface roughening treatment.

A cylindrical support used in preparation of a fixing member having an elastic layer is composed of a support (cylindrical core) and an elastic layer formed on the outer periphery of the support, when a fixing roll is prepared as the fixing member. On the other hand, when a fixing belt is prepared as the fixing member, the cylindrical support is composed of a cylindrical tube, an endless belt-type support fixed onto the outer periphery of the cylindrical tube, and an elastic layer formed on the outer periphery of the support. The outer periphery of the elastic layer may be subjected to a primer treatment prior to the subsequent processes.

The cylindrical support used in formation of the surface layer described above can be prepared by the same manufacturing method as that for manufacturing a conventional fixing member before the formation of the surface layer. The thickness of each layer such as the support constituting the cylindrical support is constant in the axial direction.

In the first embodiment, the surface layer of the fixing member is formed at least through a step of forming a coating film by coating the outer periphery of the cylindrical support with a coating solution for forming the surface layer by an ink jet method, as described above. Usually, the step of forming the coating film is followed by a step of drying the coating film as necessary, and finished by a step of baking the resulting semidried or dried coating film, thereby forming the surface layer.

The treatment time and treatment temperature in the drying step and baking step can be selected depending on the compositions of the coating solutions for forming a surface layer to be used, and when a PFA dispersion is used as the coating solution, the treatment time in the drying step can be, for example, in the range of 5 minutes or more and 10 minutes or less, the drying temperature can be in the range of 80° C. or higher and 120° C. or lower, the treatment time in the baking step can be in the range of 25 minutes or more and 30 minutes or less, and the baking temperature can be in the range of 300° C. or higher and 320° C. or lower.

For the formation of the surface layer, it can be considered to use a conventionally well-known dipping coating method, a ring slot die method for coating in the vertical direction, or a method of forming a film in a spiral form by allowing a fluid to continuously run through a nozzle as disclosed in JP-A No. 3-193161 and the like. By these methods, however, it is basically difficult to apply an application liquid in such a manner that the composition thereof varies in the width direction of the surface layer, while satisfying the other necessary requirements (for example, coating thickness unevenness) of the fixing member.

In these methods, unlike the ink jet method, it is also difficult to apply the same kind of coating solution, with very high resolution, onto the same position on the cylindrical support. Accordingly, it is expected that the variation in products is significant, thereby making the method little practicable.

The spray coating method, as opposed to the above methods, including ejecting and spraying of the liquid droplets onto a cylindrical support, thus appears to be applied to the formation of a surface layer of the fixing member of the first embodiment by using, for example, two or more kinds of coating solutions for forming a surface layer having different compositions from each other and two or more spray guns corresponding respectively to each of the solutions. However, as compared with the ink jet method, the direction in which the ejected liquid droplets fly from the nozzle of the spray gun is too broad, and the position at which the liquid droplets land on the surface of the cylindrical support is little controllable. Accordingly, unevenness in the coating thickness may easily occur in the width direction of the surface layer as described above, and the difference in the width direction between the maximum value and minimum value of the thickness of the surface layer cannot be regulated to be 5 μm or less, as is the case of the fixing member of the first embodiment.

Further, since the average diameter of the liquid droplets is large and the distribution thereof is broad, the profile of dynamic friction coefficient in the width direction of the surface layer is hardly accurately regulated as compared with the cases of using the ink jet method.

On the other hand, in the ink jet method, as compared with the spray coating method, the liquid droplet discharging head used as a liquid droplet eject means has the advantages such as: (1) straightness of direction and high accuracy of position of the ejected liquid droplets; and (2) constant diameter of the liquid droplets, as compared with a spray gun. This liquid droplet discharging head, unlike a spray gun having one nozzle (discharge spout), has two or more nozzles arranged on a nozzle face, wherein the diameter of the nozzles is smaller than that of the spray gun and is usually in the range of 20 μm or more and 30 μm or less. Further, the liquid droplets are ejected from the nozzles in substantially parallel with the nozzle axis (in the range of 0 to 5° to the nozzle axis) unless force, such as wind blown across the nozzle axis, is applied to the liquid droplets ejected from the nozzles.

Further, as a secondary effect of the ink jet system, the amount of solvent vapor or the amount of coating solutions to be wasted can be reduced as compared with conventional dipping coating methods. Further, there is no need of wiping the bottom part of the fixing member, as required in the dipping coating method, since coating is selectively performed onto a specified region.

The liquid droplets are ejected from the liquid droplet discharging head in the ink jet system and reach the cylindrical support, while increasing the solid content thereof during flying. Accordingly, the liquid droplets coalesce with each other to form a liquid film and are leveled on the surface of the cylindrical support, then dried and solidified to form a dry coating film. The index L that shows the degree of tendency of leveling is expressed as a function of the surface tension of a coating film, thickness of a wet film, viscosity and wavelength. Among these, wavelength contributes most significantly to leveling, and when the resolution upon reaching the surface is higher, leveling properties are more improved.

Accordingly, the surface layer having a composition in the width direction being regulated with high accuracy can be formed by using the ink jet method capable of ejecting liquid droplets having small diameters with less variation onto the desired positions.

In the ejecting system in the ink jet method, common systems of continuous or intermittent type (for example, piezoelectric element type, thermal type or electrostatic type) and the like can be used. Among these, the ones of continuous or intermittent type utilizing the piezoelectric system are preferable, and the piezoelectric intermittent system is more preferable from the viewpoint of forming a thin film and of reducing the amount of waste liquid.

FIGS. 4 to 8 are schematic views showing the method of forming a surface layer on the surface of a cylindrical support (cylindrical support having a round section) by an ink jet method using a scanning liquid droplet discharging head capable of scanning in the axial direction of the cylindrical support. In the invention, however, the method of forming the surface layer is not limited thereto.

The "scanning type" is a system of coating with liquid droplets ejected from a scanning liquid droplet discharging head that scans in parallel with the width direction of the tubular support (or in parallel with the axial direction when the support is cylindrical).

Figure 4:
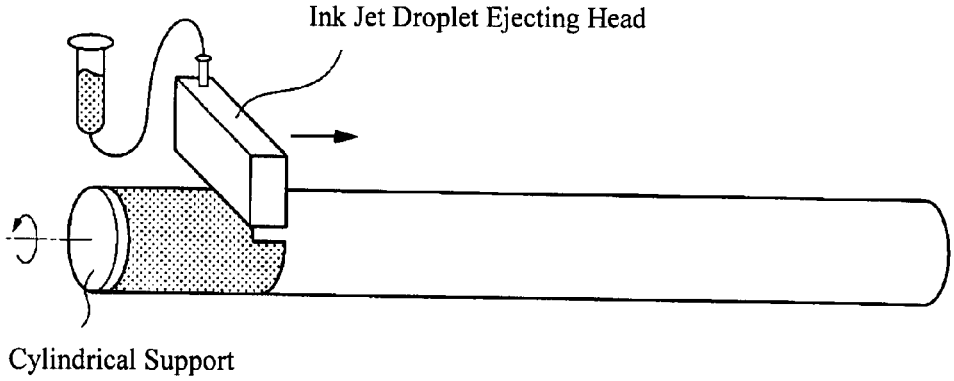
FIG. 4 is a schematic view showing an example of a method of forming a surface layer onto the surface of a cylindrical support by an ink jet method using a scanning liquid droplet discharging head capable of scanning in the axial direction of the cylindrical support.

FIG. 4 is an example of an ink jet system of using a liquid droplet discharging head used in a common ink jet printer, in which the liquid discharging head having plural nozzles in the longitudinal direction. In FIG. 4, a simple syringe as a source for supplying a coating solution is also connected to the liquid droplet discharging head.

In FIG. 4 is shown only one liquid droplet discharging head. However, there are usually two or more liquid droplet discharging heads capable of independently scanning in the width direction of the cylindrical support, and different coating solutions from one another are respectively ejected from each of the liquid droplet discharging heads.

Alternatively, when only one liquid droplet discharging head is used, two or more syringes are usually connected to the liquid droplet discharging head, and the respective syringes are charged with different kinds of coating solutions, respectively. Different kinds of coating solutions are ejected from different nozzles respectively. The expression "different kinds of coating solutions" means that the dynamic friction coefficient of the films formed by respective coating solutions, when singly used, are different from each other, and refers to, in a case of PFA dispersions for example, the dispersions in which the PFAs having different copolymerization ratios of two types of monomers are respectively dispersed.

When the cylindrical support is arranged with its axis directed horizontally, usually the cylindrical support is rotated and simultaneously coated with liquid droplets. The resolution of the ejecting that influences the qualities of a coating film is determined by the direction of scanning and the angle of the nozzle array.

Figure 10:
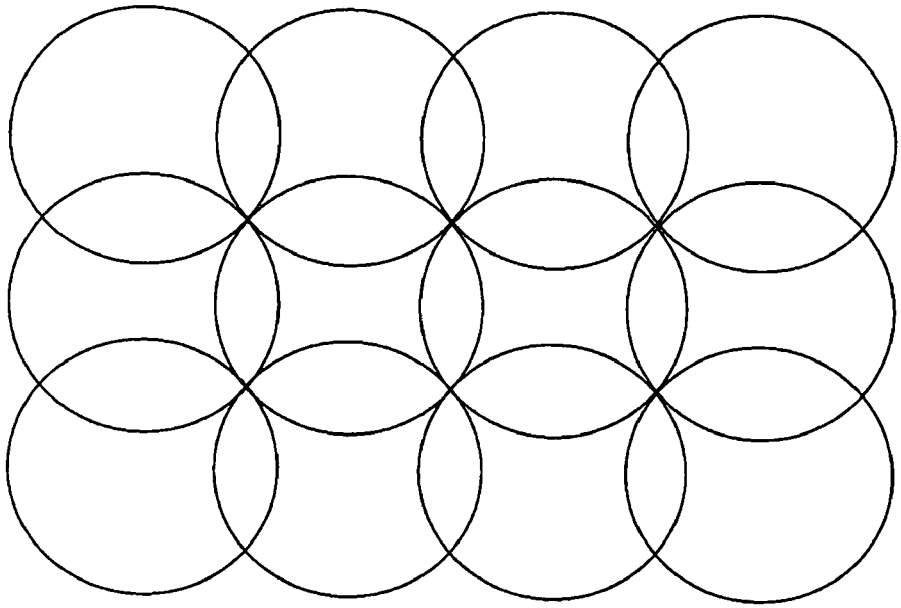
FIG. 10 is a schematic view showing a state of liquid droplets that have reached the surface of a cylindrical support after being discharged from a liquid droplet discharge means.

As shown in FIG. 10, the resolution of ejecting of liquid droplets (the number of pixels in a coating solution in 1 inch width) is preferably regulated such that the liquid droplets, having landed on the surface of an object, spread to contact with adjacent liquid droplets and eventually form a coating film. The application may be conducted in consideration of the surface tension of the cylindrical support, state of spreading of liquid droplets upon reaching the surface, size of the liquid droplets upon ejecting, evaporation speed of the coating solvent that are attributed to the concentration of the solvent and the type of the solvent, and the like. These conditions are determined by the type or composition of the material for the coating solution, or the physical properties of the surface of the cylindrical support to be coated, which are preferably regulated.

Figure 11A:
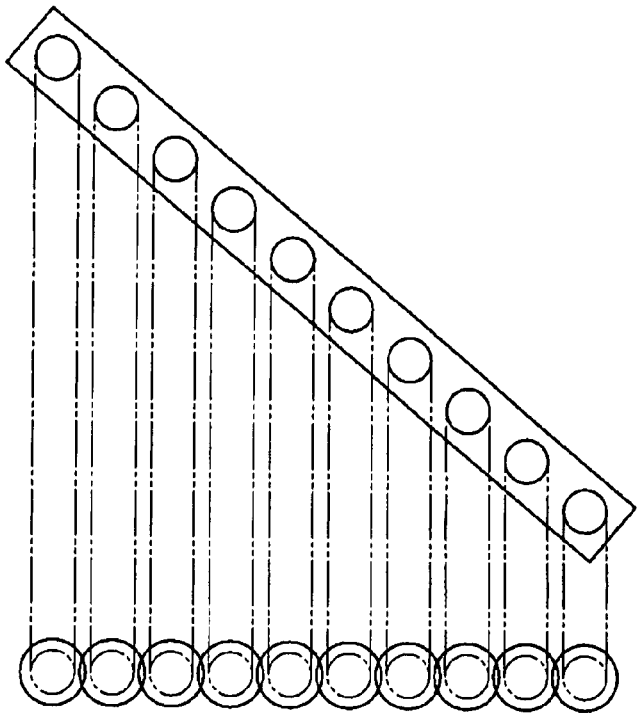
FIGS. 11A and 11B are schematic views showing an example of a method of improving the apparent resolution in a method of forming a surface layer by an ink jet method.

However, as described above, it is difficult to shorten the distance between the nozzles to improve the resolution in the piezoelectric ink jet liquid droplet discharging head. Therefore, in consideration of the distance between the nozzles, it is preferable that the liquid droplet discharging head is arranged in a slanted manner against the axis of the cylindrical support, as shown in FIG. 1A and FIG. 1B, such that the liquid droplets contact with adjacent liquid droplets after being ejected from the nozzles and have reached the surface, as shown in FIG. 10, thereby improving apparent resolution. As shown in FIG. 11A, the diameter of the liquid droplets at the time of ejecting is almost the same as that of the nozzle as indicated by the dashed line, but after reaching the surface of the cylindrical support, the liquid droplets spread as indicated by the solid line, thereby contacting with adjacent liquid droplets to form a layer.

Figure 12:
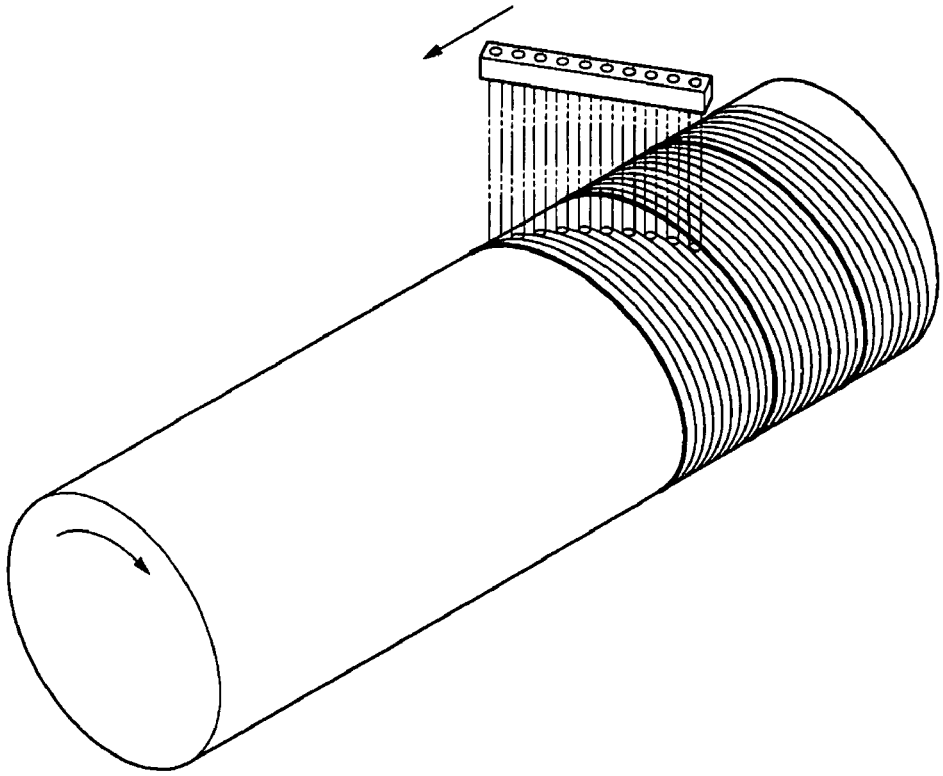
FIG. 12 is a schematic view showing another example of the method of forming a surface layer onto the surface of a cylindrical support by an ink jet method using a scanning liquid droplet discharging head capable of scanning in the axial direction of the cylindrical support.

In this state, the cylindrical support is rotated, and a coating solution is ejected from the nozzles as the liquid droplet discharging head moves horizontally from one end of the cylindrical support to the other end, as shown in FIG. 12. The process is repeated to make the surface layer thicker.

Specifically, the cylindrical support is mounted onto a device capable of horizontally rotating, and the liquid droplet discharging head charged with a surface layer-forming coating solution is placed in such a manner that the liquid droplets are ejected onto the cylindrical support. It is preferable that the nozzles that do not eject the liquid onto the cylinder is closed, in terms of reducing the amount of waste liquid, since the object onto which the liquid droplets are ejected is in the form of a cylinder having a small diameter.

In the example shown in FIG. 4, a cylindrical support is used as a member to be coated. On the other hand, when a fixing belt is prepared as the fixing member, it is also possible to form a surface layer by training a member to be coated on two rolls, wherein the member is in the form of an endless belt and has not been provided with a surface layer, and wherein one of these rolls functions as a driving roll, then placing the liquid droplet discharging head to face to the flat area in the outer periphery of the member to be coated.

Figure 5:
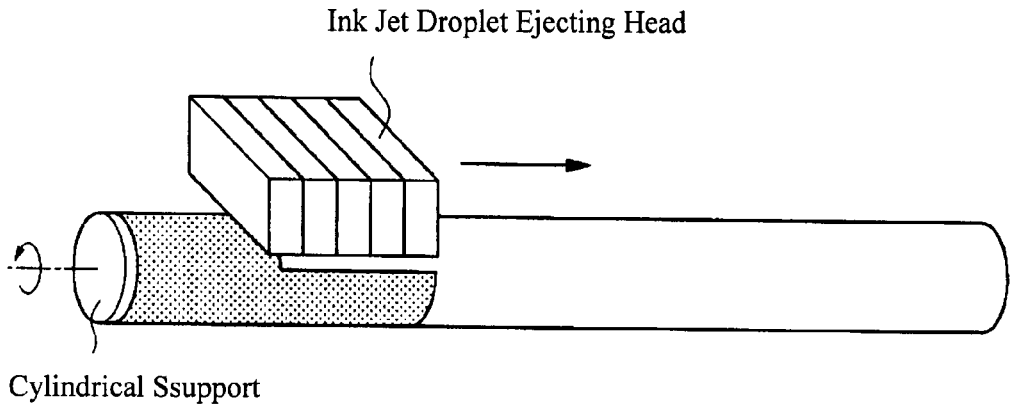
FIG. 5 is a schematic view showing an example of a method of forming a surface layer onto the surface of a cylindrical support by an ink jet method using an integrated head having a plurality of the liquid droplet discharging heads shown in FIG. 4 that are connected to each other and arranged in a matrix form in the axial direction of the cylindrical support.

FIG. 5 is a schematic view showing an example of the method of forming a surface layer on the surface of a cylindrical support by an ink jet method using an integrated head, wherein plural liquid droplet discharging heads, one of which is shown in FIG. 4, are connected with each other in the axial direction of the cylindrical support and arranged in a matrix manner. In this case, a large amount of liquid droplets can be ejected at the same time from the integrated head and the area to be applied is broadened, thereby enabling high-speed coating. Further, by selecting the ejecting nozzles to eject or arranging the nozzles having different sizes in matrix, the amount of the ejected liquid droplets can be easily regulated. In this case, each of the liquid droplet discharging head units constituting the integrated head ejects a single type of coating solution.

Figure 6:
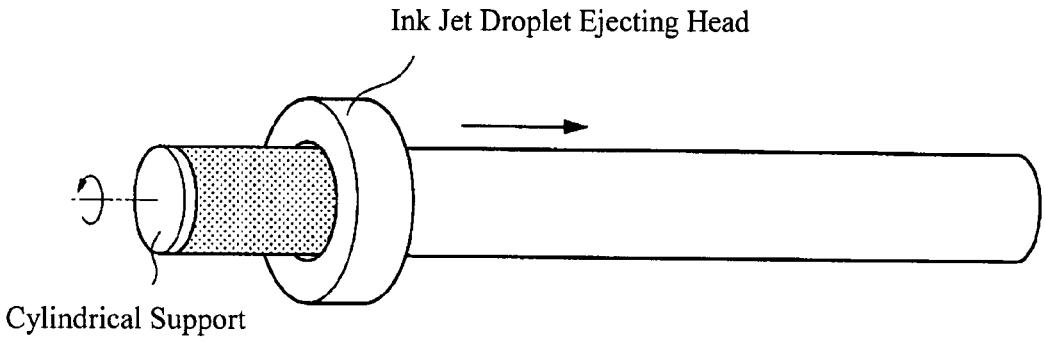
FIG. 6 is a schematic view showing an example of a method of forming a surface layer onto the surface of a cylindrical support by an ink jet method using a cylindrical liquid droplet discharging head arranged so as to surround the periphery of the cylindrical support.

FIG. 6 is a schematic view showing an example of the method of forming a surface layer on the surface of a cylindrical support by an ink jet method using a cylindrical liquid droplet discharging head placed so as to enclose the circumference of the cylindrical support. Eject nozzles are usually formed at predetermined intervals in the circumferential direction of the inner periphery of the cylindrical liquid droplet discharging head. By using the cylindrical liquid droplet discharging head, coating thickness unevenness in the circumferential direction can be further reduced and a coating film without distinct spiral stripes can be formed.

Figure 7:
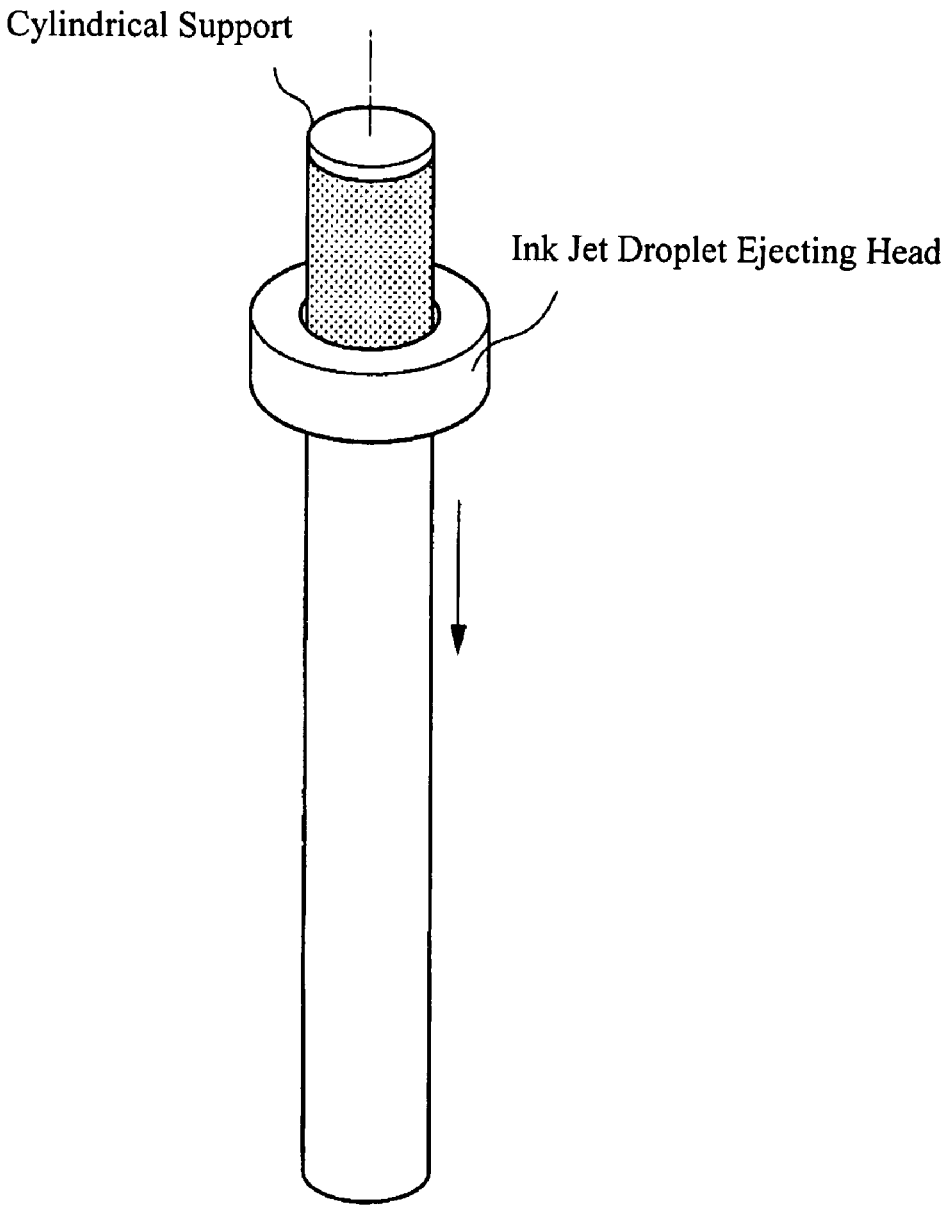
FIG. 7 is a schematic view showing a case of forming a surface layer as shown in FIG. 6, wherein the cylindrical support is arranged with its axial direction being in a vertical direction.

FIG. 7 is a schematic view of the method of forming a surface layer shown in FIG. 6 wherein the cylindrical support is placed so that its axis is in a vertical direction. The vertical direction means not only 90° but also an angle deviated from 90°.

Figure 8:
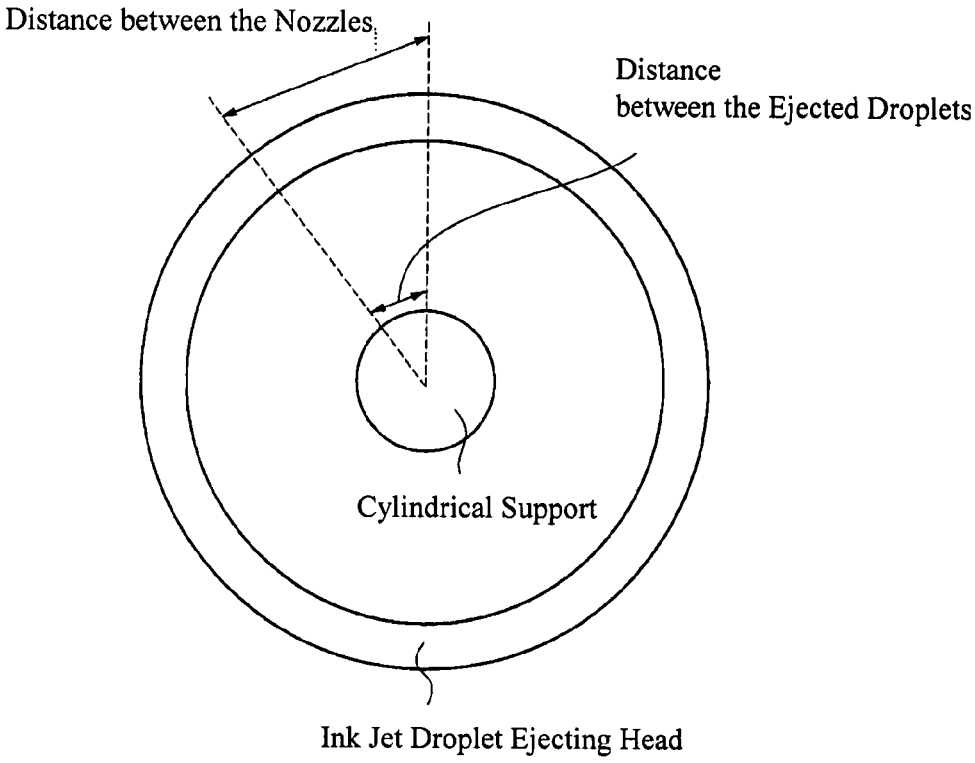
FIG. 8 is a schematic view showing an example of the cylindrical liquid droplet discharging head.
Figure 11B:
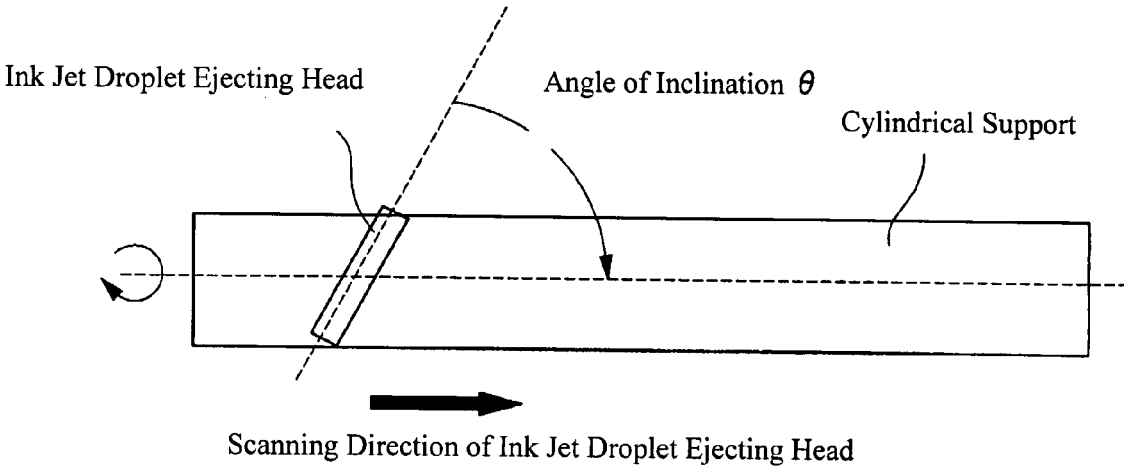

In FIGS. 6 and 7, a coating film can be formed without rotating the cylindrical support. In these cases, however, it is not possible to use the method shown in FIGS. 11A and 11B wherein the apparent resolution is improved by allowing the rotation axis and the nozzle array to have a certain angle therebetween. In the case of the cylindrical liquid droplet discharging head, however, the distance of the liquid droplets to reach the surface can be shortened by increasing the diameter of the liquid droplet discharging head, thereby improving the resolution on the cylindrical support, as shown in FIG. 8. Therefore, in the case of the piezoelectric liquid droplet discharging head, a high-quality coating film can be formed by using a cylindrical liquid droplet discharging head, although the distance between the nozzles is difficult to shorten in manufacturing.

FIGS. 6 and 8 show the cases where a single cylindrical liquid droplet discharging head is used. In this case, a cylindrical liquid droplet discharging head provided with two or more lines of nozzle groups arranged linearly in the longitudinal direction of the cylindrical liquid droplet discharging head is used, and two or more kinds of coating solutions that are different from each other are respectively ejected from each of the nozzle lines.

Alternatively, two or more cylindrical liquid droplet discharging heads capable of independently scanning in the axial direction of the cylindrical support may be arranged and the coating solutions that are different from each other are respectively ejected from each of the cylindrical liquid droplet discharging heads.

Further, similarly to the case shown in FIG. 5, plural cylindrical liquid droplet discharging heads connected with each other may be arranged in the axial direction of the cylindrical support.

Figure 9:
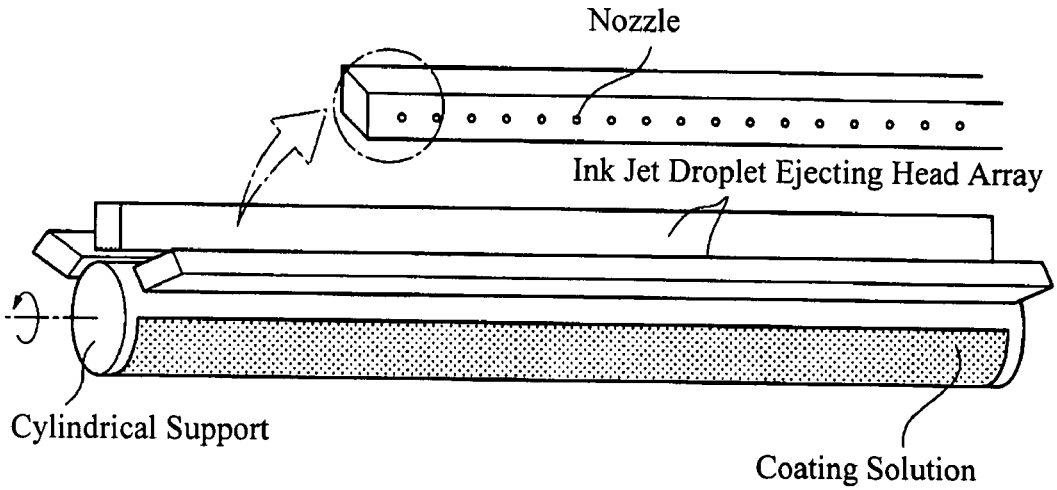
FIG. 9 is a schematic view showing an example of a method of forming a surface layer onto the surface of a cylindrical support by an ink jet method, wherein the surface layer is applied all over the axial direction of the support at the same time, and wherein the width of the liquid droplet discharging head is equal to, or greater than, the length of the cylindrical support in the axial direction.

FIG. 9 is a schematic view showing an example of the method of forming a surface layer by an ink jet method wherein a liquid droplet discharging head has the width equal to or greater than the length of the axial direction of a cylindrical support, thereby coating the surface of the cylindrical support over the whole length at the same time in the axial direction.

When the cylindrical support is arranged so that the axis thereof is in the horizontal direction as shown in FIG. 9, usually coating is performed as the cylindrical support is rotated. As described above, it is difficult to reduce the distance between the nozzles in the piezoelectric ink jet liquid droplet discharging head, and a resolution with which a high-quality film can be formed is hardly obtained.

As a means to solve this problem, it may be considered to use two or more liquid droplet discharging heads, as shown in FIG. 9, for example. Alternatively, even in a case where a single liquid droplet discharging head is used, a coating film can be continuously formed by slightly scanning in the axial direction to fill the difference between the nozzles.

In the example shown in FIG. 9, a predetermined kind of coating solution is ejected from the nozzle at predetermined position in the longitudinal direction of the liquid droplet discharging head, thereby enabling varying of the composition of a material constituting the surface layer in the width direction of the surface layer.

In the examples shown in FIGS. 4 to 7 where a scanning-type liquid droplet discharging head is used, the composition of the surface layer in the width direction can be varied to attain a desired profile of the dynamic friction coefficient on the surface of the surface layer in the width direction, by scanning with the liquid droplet discharging head in the axial direction of the cylindrical support while changing the ejecting amount per unit time of each kind of the coating solutions.

For example, when an integrated head in which five liquid droplet discharging heads are integrated therein, as shown in FIG. 5, is used to form a surface layer, a first PFA dispersion is ejected from one of the liquid droplet discharging heads (first liquid droplet discharging head), and a second PFA dispersion being different from the first PFA dispersion is ejected from a liquid droplet discharging head adjacent to the first liquid droplet discharging head (second liquid droplet discharging head).

The surface layer having an increasing profile (or a decreasing profile) can be formed by: regulating the first liquid droplet discharging head such that the ejecting amount per unit time increases as the integrated head moves toward the both ends of the cylindrical support, while the ejecting amount decreases as the integrated head moves toward the center; and regulating the second liquid droplet discharging head such that the ejecting amount per unit time decreases as the integrated head moves toward the both ends of the cylindrical support, while the ejecting amount per unit time increases as the integrated head moves toward the center.

Alternatively, such a profile can also be obtained by scanning the cylindrical support in a stationary state with the head in the axial direction and ejecting a coating solution in a desired pattern onto the cylindrical support, in a similar manner to that of a commercial printer is scanned, and thereafter the cylindrical support is rotated at a certain angle in the circumferential direction, then scanned again with the head to eject a coating solution, thereby forming a continuous film.

When a continuous-type liquid droplet discharging head is used, the direction in which the liquid droplets travel is changed by bias in an electric field, whereby the amount of a coating solution that reaches the surface of the cylindrical support can be regulated. The liquid droplets that were not applied on the support are recovered through a gutter.

When an intermittent-type liquid droplet discharging head is used, the amount to be ejected can be regulated, for example, by regulating the ejecting frequency, or voltage or time of the pulse. The ejecting itself can be stopped by stopping applying of the pulse.

The viscosity of a coating solution used in the intermittent-type ink jet liquid droplet discharging head is preferably in the range of 0.8 mPa·s or more to 20 mPa·s or less, more preferably in the range of 1 mPa·s or more and 10 mPa·s or less.

The viscosity of the coating solution in this embodiment refers to a value determined by an E-type viscometer (trade name: RE550L, standard cone rotor, revolution rate; 60 rpm, manufactured by Toki Sangyo Co., Ltd.) in an atmosphere at 25° C.

The viscosity of the coating solution can be regulated by selecting the solid density in the coating solution or the type of solvent.

When a coating solution at high concentration, i.e., a coating solution of high viscosity is used for the purpose of reducing the amount of the solvent released into the air, a continuous-type ink jet liquid droplet discharging head that applies pressure to the coating solution is preferably used. However, an intermittent-type ink jet liquid droplet discharging head can also be used for a highly viscous material, by providing a heater for heating the coating solution which is used in a commercially available bar coat printer to reduce viscosity at the ejecting point. Although the range of selection of the coating solutions is limited in this case, an ink jet liquid droplet discharging head of electrostatic and intermittent-type can be applied to a solution with high viscosity.

The amount per liquid droplet to be ejected is preferably 1 pl to 60 pl, more preferably 1.5 pl to 55 pl, and still more preferably 2.0 pl to 50 pl. When the amount per liquid droplet is in this range, nozzle clogging hardly occurs and there is also an advantage from the viewpoint of productivity. Further, the concentration of the liquid droplets that reach the surface of the cylindrical support per unit area per unit time can be easily regulated.

In the invention, the amount of a liquid droplet is defined as the one determined by off-line visualization evaluation. The diameter of a liquid droplet is determined by observing an image obtained by flashing LED in synchronization with the timing of ejecting to the liquid droplets, by a CCD camera. The amount of a liquid droplet can be calculated from the above diameter of a liquid droplet and the density of the coating solution.

The method of forming a layer by an ink jet method that has been described here is only for the case of forming a surface layer, but this ink jet method can also be applied to formation of other layers such as an elastic layer, if any included in the fixing member.

<Fixing Device>

The fixing device of the invention includes at least a heating member and a pressing member arranged so as to be in contact with the heating member, wherein the one selected from the heating member and the pressing member serves as a fixing member at a driving side, and the other member serves as a fixing member at a driven side that is driven by the fixing member at the driving side. In this fixing device, a recording medium having a non-fixed toner image formed thereon is passed through a contact portion between the heating member and the pressing member, thereby fixing the non-fixed toner image onto the recording medium.

Here, the fixing member of the invention is used as at least one of the pair of fixing members composed of the heating member and pressing member.

When the fixing member of the invention is used as a fixing member at the driving side, a fixing member is used which has a surface layer whose dynamic friction coefficient in the width direction of the support at 120° C. increases from the center to the both ends, i.e., a fixing member having an increasing profile.

When the fixing member of the invention is used as a fixing member at the driven side, a fixing member is used which has a surface layer whose dynamic friction coefficient in the width direction of the support at 120° C. decreases from the center to the both ends, i.e., a fixing member having a decreasing profile.

The heating member is heated by a heating device such as a heating lamp or an electromagnetic induction heating device arranged inside or outside of this heating device. The fixing member at the driving side is driven with a driving source such as a motor, and if necessary, via a driving force transmission member such as a gear or shaft. The contact portion is formed by the heating member and pressing member that are arranged so as to be in contact with, and pressurize, each other.

When only one of the pair of fixing members used in the fixing device consists of the fixing member of the invention, any conventionally known fixing member can be used as the other fixing member without particularly limited. However, when this fixing member is a fixing roll, it is particularly preferable to use a fixing roll whose outer diameter is constant in the width direction (the variation in dimension in the width direction is within ±50 μm). This is because when a fixing roll has a flare shape, i.e., the outer diameter thereof decreases in the direction from the both sides toward the center in the axial direction, an effect of preventing paper crease may be adversely diminished, or because when a fixing roll has a flare shape, variation in paper crease-preventing performance among fixing devices becomes significant, and the cost of the fixing device increases.

In the fixing device of the invention, the fixing member of the invention is used as at least one of a pair of fixing members, wherein the dynamic friction coefficient in the width direction on the surface of the surface layer of the fixing member varies due to the material constituting the surface layer itself. Accordingly, the fixing device of the invention is applicable to so-called oilless fixing, wherein fixation is performed without supplying a liquid lubricant such as silicone oil to the contact portion between the heating member and pressing member, from a liquid lubricant-supplying device placed in the fixing device. In the invention, when a liquid lubricant is supplied onto the surface of the fixing member, apparent variation in the dynamic friction coefficient in the width direction on the surface of the surface layer of the fixing member of the invention used in the fixing device becomes more uniform, thus decreasing the paper crease-preventing effect. Accordingly, it is particularly preferable that the fixing device of the invention does not have a liquid lubricant supplying device for supplying a liquid lubricant onto the contact portion between the heating member and pressing member.

When fixation is performed with the fixing device, a recording medium is passed through the contact portion such that the center in the width direction of the surface layer of the fixing member and the central line of the recording medium substantially conform with each other (i.e., difference in width between the center and central line is in the range of ±1 mm in the width direction), regardless of its size and shape, or the direction in which the recording medium passes through the contact portion (whether the longer or shorter direction of the recording medium conforms with the width direction of the fixing member). When the central line of the recording medium passing through the contact portion does not substantially conform with the central portion in the width direction of the surface layer of the fixing member of the invention, the paper sheet may not be prevented from being creased.

Specific examples of the fixing devices of the invention are now described by reference to the drawings, however, the invention is not limited to the following embodiments.

In the following descriptions regarding the embodiments shown in the drawings, one of a pair of fixing members is a fixing member at the driving side connected to a driving source (not shown) and the other is a fixing member at the driven side, and the fixing member of the invention is used as at least one member selected from a fixing member at the driving side and a fixing member at the driven side.

Figure 13:
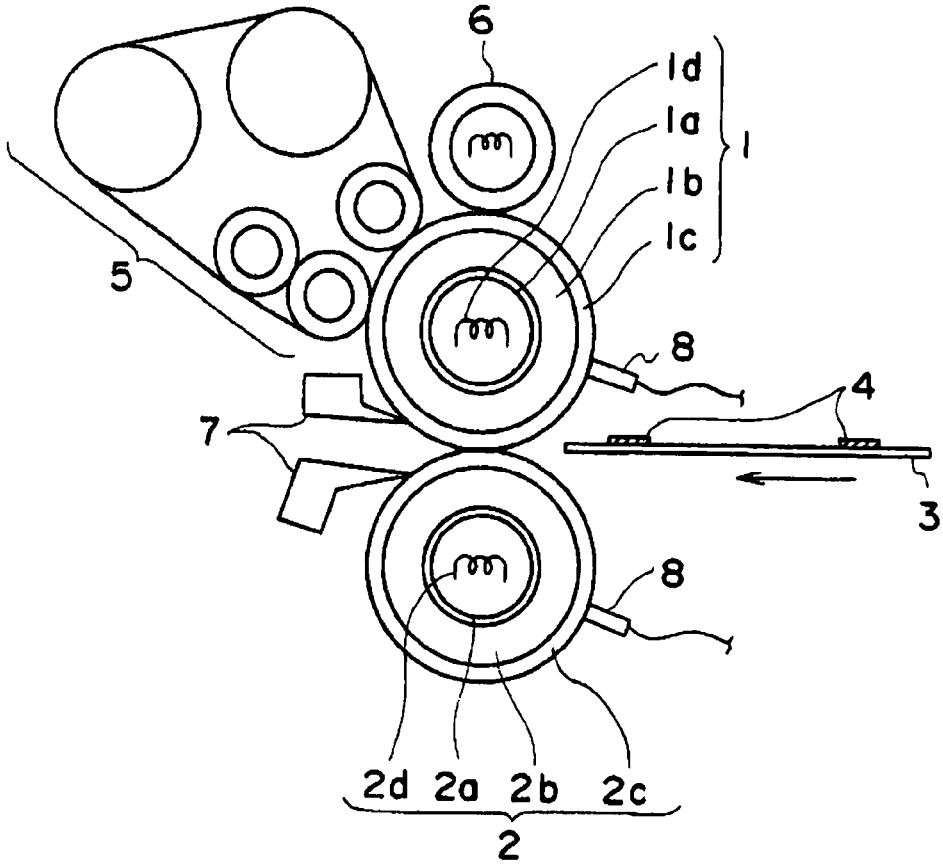
FIG. 13 is a schematic view of a heat roll-type fixing device according to a first embodiment of the invention.

FIG. 13 is a schematic view of the fixing device according to the first embodiment of the invention, i.e., a heat roll-type fixing device. In the heat roll-type fixing device shown in FIG. 13, a heat roll 1 and a pressing roll 2, a pair of fixing members constituting the main part of the fixing device, are arranged so as to face each other and contact with each other to form a contact portion.

The heat roll 1 comprises an elastic layer 1*b* and a release layer 1*c*, the layers being formed in this order on the outer periphery of a cylindrical core 1*a* having a heat source 1*d* such as a heater lamp therein. On the outer periphery of the heat roll 1 is provided a cleaning unit 5 for cleaning the surface of the heat roll 1, an external heating device 6 for supplemental heating of the surface of the heat roll 1, a release nail 7 for releasing a recording medium 3 after fixation, and a temperature sensor 8 for controlling the surface temperature of the heat roll 1.

The pressing roll 2 comprises an elastic layer 2*b* and release layer 2*c*, the layers being formed in this order on the outer periphery of a cylindrical core 2*a* having a heat source 2*d* such as a heater lamp therein. On the outer periphery of the pressing roll 2 is provided the release nail 7 for releasing the recording medium 3 after fixation, and the temperature sensor 8 for controlling the surface temperature of the pressing roll 2.

The recording medium 3 having non-fixed toner image 4 formed thereon is passed through the contact portion formed by the heat roll 1 and pressing roll 2, thereby fixing the non-fixed toner image 4.

Figure 14:
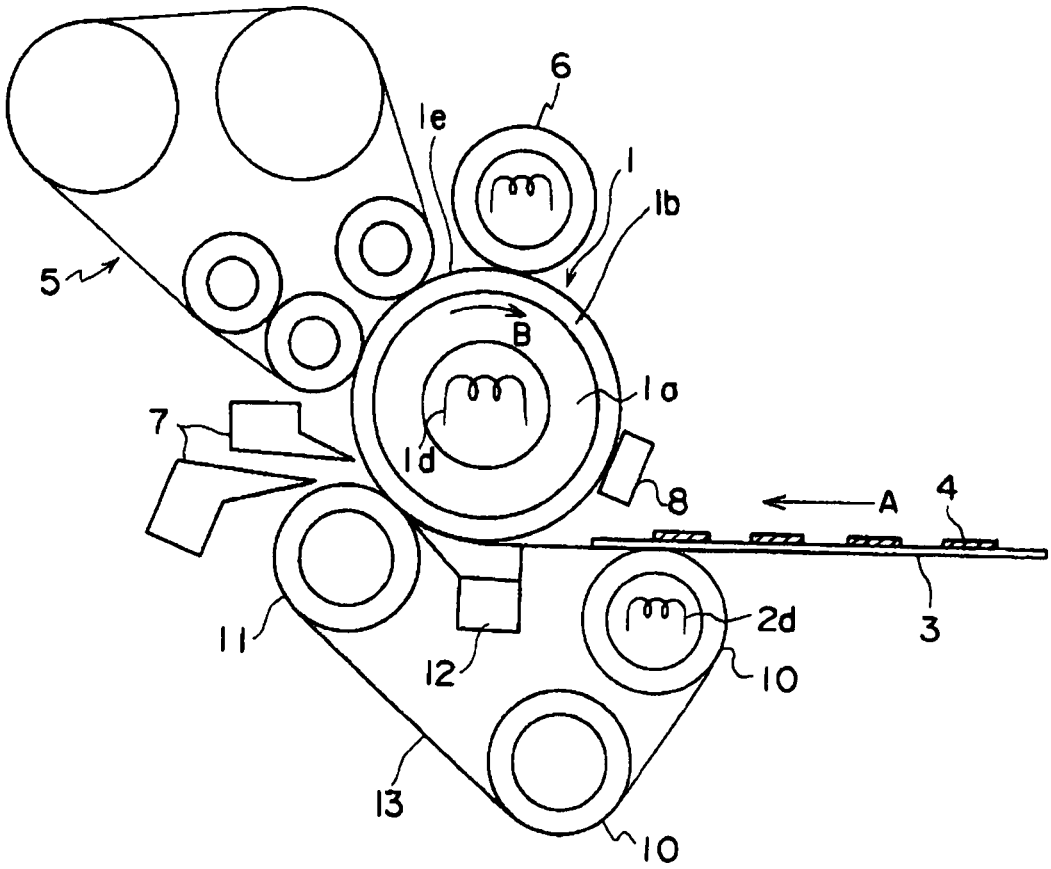
FIG. 14 is a schematic view of a heat roll/belt-type fixing device according to a second embodiment of the invention.

FIG. 14 is a schematic view of the fixing device according to the second embodiment of the invention, i.e., a heat roll/belt-type fixing device. The heat roll/belt-type fixing device according to the second embodiment of the invention has a pair of fixing units including a heat roll and a pressing belt that comes in contact with the heat belt, wherein a recording medium having a non-fixed toner image thereon is passed through the contact portion formed by the heat roll and pressing belt, thereby fixing the image by heat and pressure.

In the heat roll/belt type fixing device shown in FIG. 14, a heat roll 1 and pressing belt 13, a pair of fixing members constituting the main part of the fixing device, are arranged so as to face each other and contact with each other to form a contact portion.

The pressing belt 13 is pressed against and brought in contact with the heat roll 1 by a pressing pad 12 (pressing member) and pressing roll 11 (pressing member) arranged inside the loop of the pressing belt 13, thereby forming a contact portion. The pressing pad 12 (pressing member) has a contact portion (pressing portion) with the pressing belt 13 in the form of a pad, and further the contact portion or the vicinity thereof may contain a rubber-like elastic part.

In the fixing device according to the second embodiment, the expression "a contact portion (pressing portion) with the pressing belt 13 in the form of a pad" means that the portion of the pressing pad 12 in contact with the pressing belt 13 is shaped so that the surface of the heat roll 1 and the inner periphery of the pressing belt 13 trained onto the pressing roll 11 and two support rolls 10 to closely contact with each other. In the phrase "the contact portion or the vicinity thereof", the term "vicinity" means a portion in the vicinity of the contact portion of the pressing pad 12 from which elasticity can be endowed to the contact portion by an elastic portion, and generally corresponds to the contact portion and a portion in the range of up to 10 mm in the vertical direction from the contact portion, in the pressing pad 12. The phrase "the contact portion or the vicinity thereof contains a rubber-like elastic part" means that at least a part of the contact portion or the portion in the vicinity thereof is composed of an elastic material. The rubber-like elastic part refers to heat resistant rubber represented by silicone rubber, fluorine rubber or the like.

The pressing pad 12 may have plural pressing portions having different hardness along the direction in which the recording medium travels. In this case, it is preferable that one pressing portion is composed of a rubber-like elastic member and the other pressing portion is composed of a rigid pressing member of a metal and the like. When the pressing pad 12 includes plural pressing portions having different hardness, the pressure in the contact region at the side from which a recording medium ejected is preferably higher than that at the side from which the recording medium enters, from the viewpoint of improving releasability of the recording medium (in particular, in a case of a thin recording medium). For example, by constituting the pressing portion at the side from which the recording medium enters in the pressing pad 12 by a rubber-like elastic member, and the pressing portion at the side from which a recording medium ejected by a rigid pressing member of a metal and the like, whereby the pressure in the contact region in the recording medium entering side can be preferably made higher than the pressure in the contact region in the recording medium ejecting side.

For improving sliding properties between the pressing pad 12 and the inner surface of the pressing belt 13, the pressing pad 12 may be arranged via a slide sheet composed of heat-resistant resin or fluorine resin interposed therebetween.

The heat roll 1 is composed by forming an elastic layer 1*b* and release layer 1*c* in this order on a cylindrical core 1*a* having a heat source 1*d* therein.

The pressing belt 13 is stretched and trained onto two support rolls 10 and one pressing roll 11, and one of the support rolls 10 has a heat source 2*d* therein. A toner image 4 is formed on a recording medium 3 such as a plain paper sheet.

On the outer periphery of the heat roll 1 is provided a cleaning unit 5 for cleaning the surface of the roll, an external heating device 6 for heating the heat roll 1 from the surface thereof, a release nail 7 for releasing a paper sheet after fixation, and a temperature sensor 8 for controlling the surface temperature of the heat roll 1.

In the fixing device shown in FIG. 14, fixation is carried out according to the processes as described below. The recording medium 3 having a non-fixed toner image 4 thereon is delivered in the direction indicated by arrow A, by a delivery device (not shown) and a pressing belt 13, then inserted through a contact region formed by the pressing belt 13 and heat roll 1 rotated in the direction of arrow B contacting with each other. In this step, the recording medium 3 passes through the contact region such that the side of the recording medium 3 with the non-fixed toner image 4 and the surface of the heat roll 1 face each other. When the recording medium 3 passes through this contact region, heat and pressure are applied to the recording medium 3, whereby the non-fixed toner image 4 is fixed onto the recording medium 3. The recording medium after fixation is then released from the heat roll 1 by a release nail 7 and ejected from the heat roll/belt fixing device.

Figure 15:
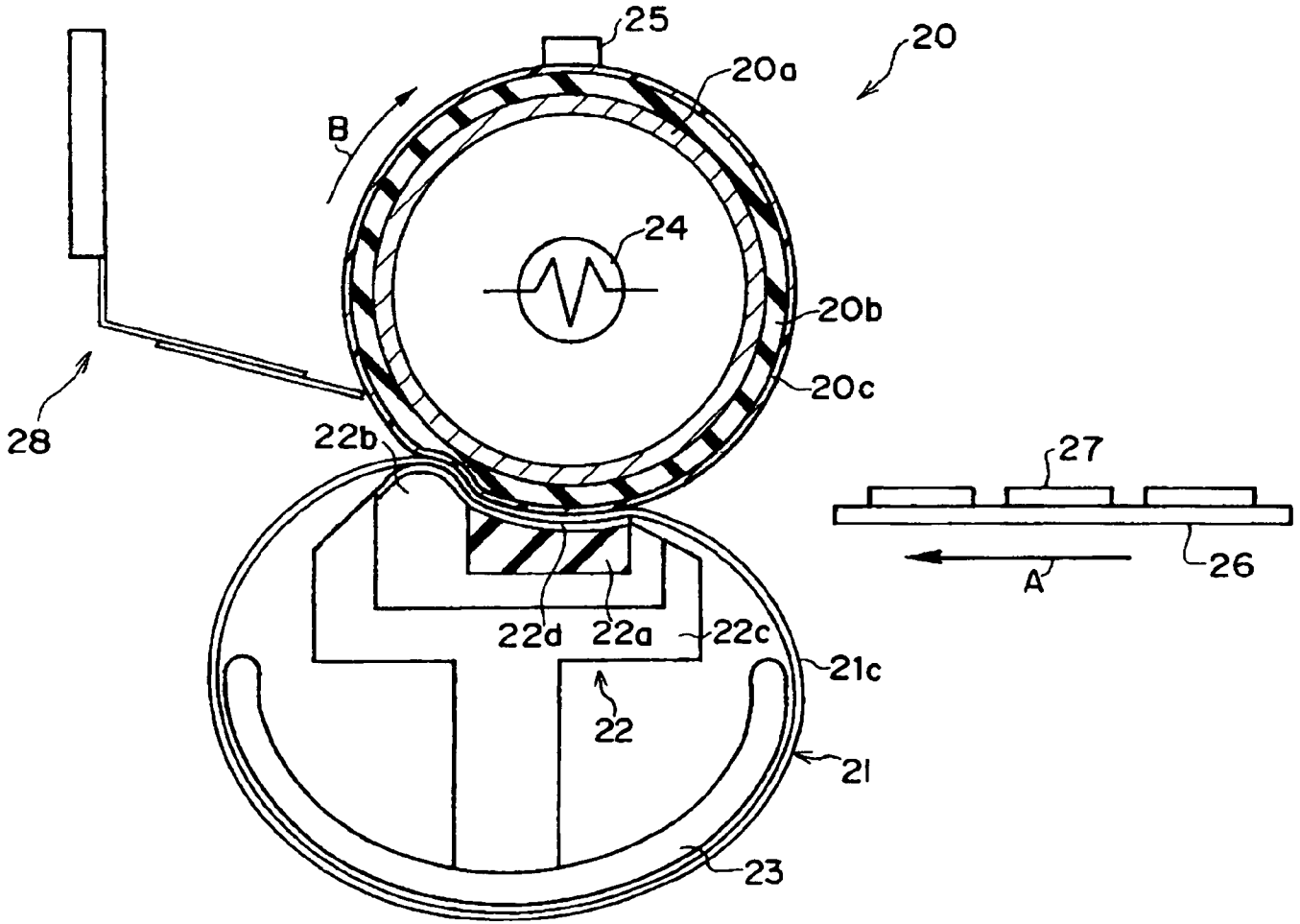
FIG. 15 is a schematic view of a free belt-type fixing device as a modified version of the second embodiment of the invention.

FIG. 15 is a schematic view of a free belt-type fixing device as a modified version of the fixing device according to the second embodiment. The free belt-type fixing device shown in FIG. 15, which is a type of a heat roll/belt fixing device designed with the aims of further downsizing, energy saving and speeding, does not have a support roll or pressing roll for stretching and training of the belt. A pressing belt 21 is guided along a belt running guide 23, and is driven by the driving force imparted by a heat roll 20. The fixing device having such a structure is called a free belt-type fixing device, in distinction from a device having a support roll or a pressing roll (fixing device shown in FIG. 14).

In the free belt-type fixing device shown in FIG. 15, the heat roll 20 and pressing belt 21, a pair of fixing members constituting the main part of the device, are arranged so as to face each other and contact with each other to form a contact portion.

The pressing belt 21 is pressed against and brought into contact with the heat roll 20 by the pressing pad 22 (pressing member) arranged inside the loop of the belt, thereby forming a contact portion and being driven by the driving force from the heat roll 20 along the belt running guide 23, as described above.

The pressing pad 22 (pressing member) has two pressing portions 22*a* and 22*b* having different hardnesses along the direction in which a recording medium travels. The pressing portion 22*a* placed on the entry side of the recording medium on the pressing pad 22 is composed of a rubber-like elastic member, and the pressing portion 22*b* on the exit side of the recording medium is composed of a rigid pressing member such as metal, whereby the pressure in the contact region on the exit side of the recording medium is made higher than the pressure on the entry side of the recording medium. In such a constitution, releasability of a recording medium (in particular, in a case of a thin recording medium) is improved. The pressing portions 22*a* and 22*b* are supported by a holder 22*c*, and the inner periphery of the pressing belt 21 is pressed against a heat roll 20 via a low-friction layer 22*d* made of a sheet of glass fiber, fluorine resin or the like.

The heat roll 20 is constituted by forming an elastic layer 20*b* and a release layer 20*c* on a cylindrical core 20*a* containing a heat source 24 therein.

The heat roll 20 is provided therearound with a release blade 28 for releasing a paper sheet after fixation and a temperature sensor 25 for regulating the surface temperature of the roll.

In the fixing device shown in FIG. 15, as is the case with the fixing device in FIG. 14, the recording medium 26 having a non-fixed toner image 27 thereon is delivered in the direction of an arrow A by a delivery device (not shown), and passes through a contact region formed by contact of a pressing belt 21 and a heat roll 20 driven to rotate in the direction of an arrow B. At this time, the recording medium 26 passes through the contact region such that the surface of the recording medium 26 having the non-fixed toner image 27 thereon and the surface of the heat roll 20 face each other. When the recording medium 26 passes through this contact region, the non-fixed toner image 27 is fixed onto the recording medium 26 by heat and pressure applied to the recording medium 26. After passing through the contact region, the recording medium 26 after being subjected to fixation is released from the heat roll 20 by the release blade 28 and ejected from the free belt fixing device. In this manner, fixation process is carried out.

In a heat roll/belt-type fixing device, the time for a recording member having a non-fixed toner image thereon to pass through a contact portion formed by a heat roll and pressing belt (time for passing through the contact portion) is desirably 0.030 second or more. When this time for passing through the contact portion is shorter than 0.030 second, favorable fixing properties and prevention of paper crease or curling are hardly satisfied at the same time, and in consequence, the fixing temperature may be required to be raised, resulting in loss of energy, lowering of durability of the members, or temperature increase in the device. The upper limit of the time for the recording medium to pass through the contact portion is not particularly limited, but is preferably 0.5 second or less from the viewpoint of balance between the processing ability for fixing and the size of the device and members.

Figure 16:
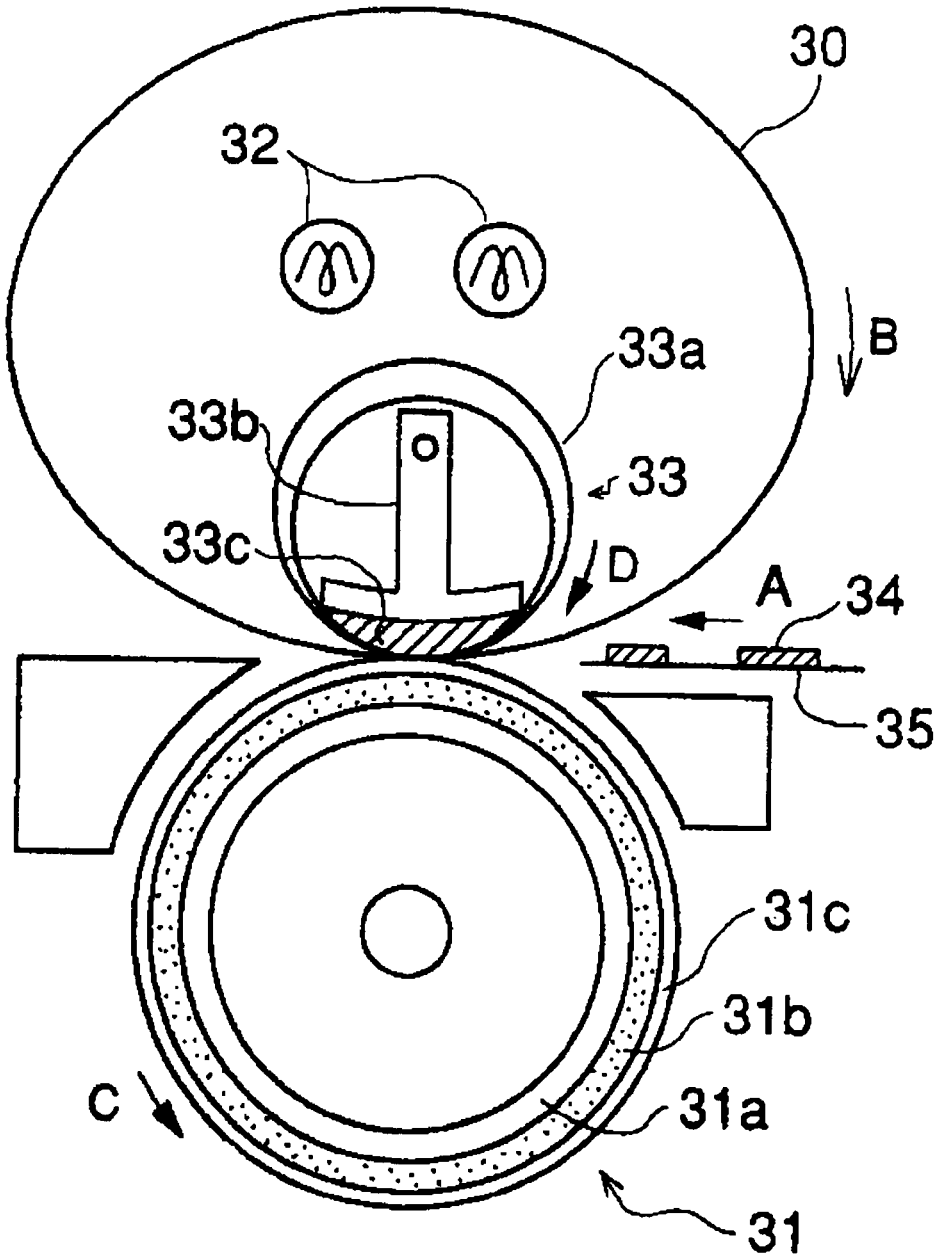
FIG. 16 is a schematic view of a heat belt/roll-type fixing device according to a third embodiment of the invention.

FIG. 16 is a schematic view of the fixing device according to the third embodiment of the invention, i.e., a heat belt/roll-type fixing device. In the heat belt/roll-type fixing device according to the third embodiment, a recording medium having a non-fixed toner image thereon passes through a contact portion formed by a heat belt and a pressing roll, and the image is fixed by heat and pressure.

In the heat belt/roll-type fixing device shown in FIG. 16, the member indicated by number 30 is a heat belt composed of a release layer formed on a support made of a heat-resistant base film (for example a polyimide film or the like). A pressing roll 31 is arranged so as to be in contact with the heat belt 30, thereby forming a contact portion. The pressing roll 31 is constituted by forming an elastic layer 31*b* made of silicone rubber or the like on a support 31*a*, and further forming a release layer 31*c* thereon.

Inside of the heat belt 30, a pressing member 33 comprising a pressing roll 33*a* made of iron or the like, an inverted T-shaped pressing member 33*b*, and a metal pad 33*c* impregnated with a lubricant are arranged in a position opposite the pressing roll 31, and the pressing member 33*b* presses the heat belt 30 via the pressing roll 33*a* against the pressing roll 31, thereby applying suppress strength to the contact portion. At this time, the pressing member 33*b* applies suppress strength while the metal pad 33*c* slides along the inner surface of the pressing roll 33*a*. The inner surface of the pressing roll 33*a* is preferably coated with heat-resistant oil having lubricity.

A heat source 32 such as a heater lamp for heating the contact portion of the heat belt 30 is arranged inside of the heat belt 30.

The heat belt 30 is rotated in the direction of arrow B in accordance with the rotation of the pressing roll 33*a* in the direction of arrow D, and accordingly, the pressing roll 31 is also driven to rotate in the direction of arrow C. A recording medium 35 having a non-fixed toner image 34 formed thereon passes through the contact portion of the fixing device in the direction of arrow A, then heat-melted and pressurized to fix the toner image.

Figure 17:
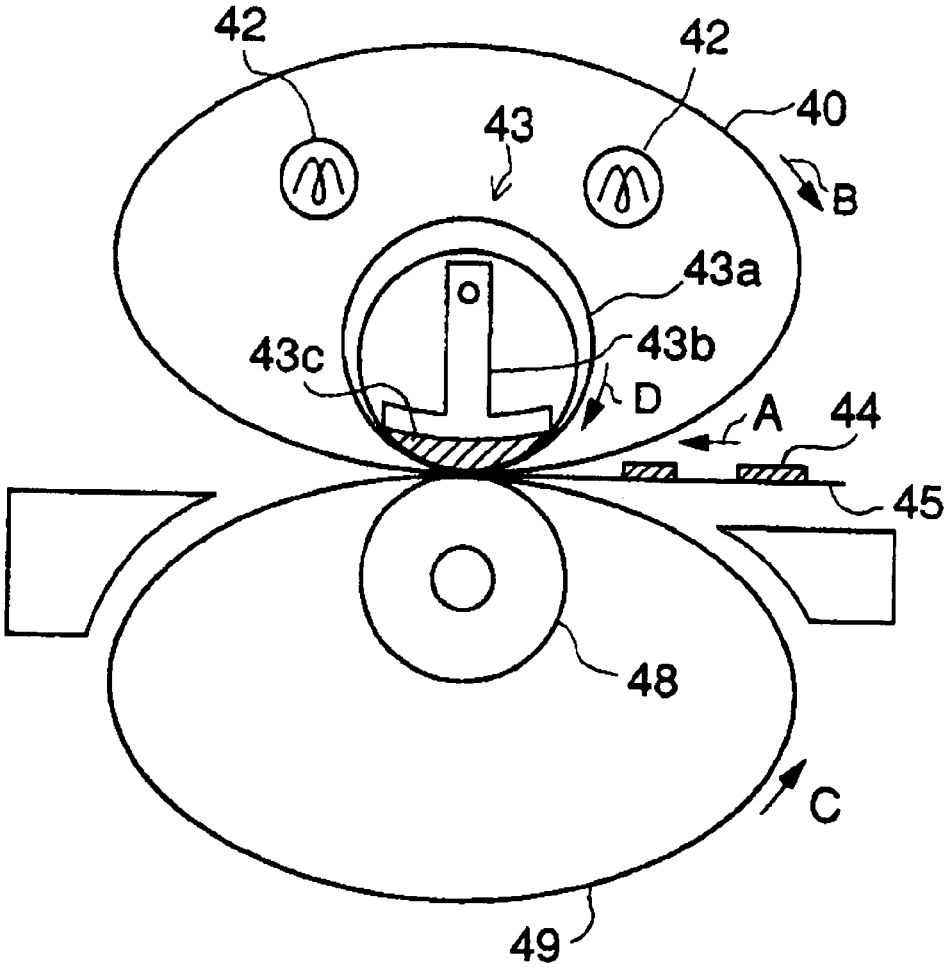
FIG. 17 is a schematic view of a heat belt-type fixing device according to a fourth embodiment of the invention.

FIG. 17 is a schematic view of the fixing device in accordance with the fourth embodiment of the invention, i.e., a heat belt-type fixing device. In the heat belt-type fixing device according to the fourth embodiment, a recording medium having a non-fixed toner image thereon passes through a contact portion formed by a heat belt and a pressing belt, and the image is fixed by heat and pressure.

In the heat belt-type fixing device shown in FIG. 17, the constitution of a heat belt 40, heat source 42 such as a heater lamp, and a pressing member 43 (a pressing roll 43*a*, pressing member 43*b* and a metal pad 43*c*) is the same as that of the fixing device shown in FIG. 16, i.e., a heat belt 30, heat source 32 such as a heater lamp and the pressing member 33 (a pressing roll 33*a*, pressing member 33*b* and a metal pad 33*c*).

A pressing roll 49 is arranged so as to form a contact area with the heat belt 40, and a contact portion is formed by the heat belt 40 and pressing belt 49. The pressing belt 49 has the same constitution as that of the heat belt 40. Inside of the pressing belt 49 is arranged a pressing roll 48 made of silicone rubber or the like in a position opposite the pressing member 43, thereby applying suppress strength to the contact portion.

The heat belt 40 is rotated in the direction of arrow B in accordance with the rotation of the pressing roll 43*a* in the direction of arrow D, and accordingly the pressing belt 49 is also driven to rotate in the direction of arrow C. A recording medium 45 having a non-fixed toner image 44 formed thereon passes through the contact portion of the fixing device, in the direction of arrow A, and heat-melted and pressurized to fix the toner image.

<Image Forming Apparatus>

Details of the image forming apparatus of the invention will not be described. The image forming apparatus of the invention is not particularly limited insofar as the apparatus is provided with the fixing device of the invention as a fixing means. Specifically, the image forming apparatus preferably comprises at least a latent image holding member, a charging means for charging the surface of the latent image holding member, a latent image-forming means for forming a latent image on the surface of the charged latent image holding member, a toner image forming means for developing the latent image with a developer to form a toner image, a transfer means for transferring the toner image from the surface of the latent image holding member onto the surface of a recording medium, and a fixing means for fixing the toner image transferred to the surface of the recording medium (i.e., the fixing device of the invention).

Hereinafter, the image forming apparatus provided with the fixing device of the invention (i.e., the image forming apparatus of the invention) is described by referring to the drawings.

First Embodiment

Figure 18:
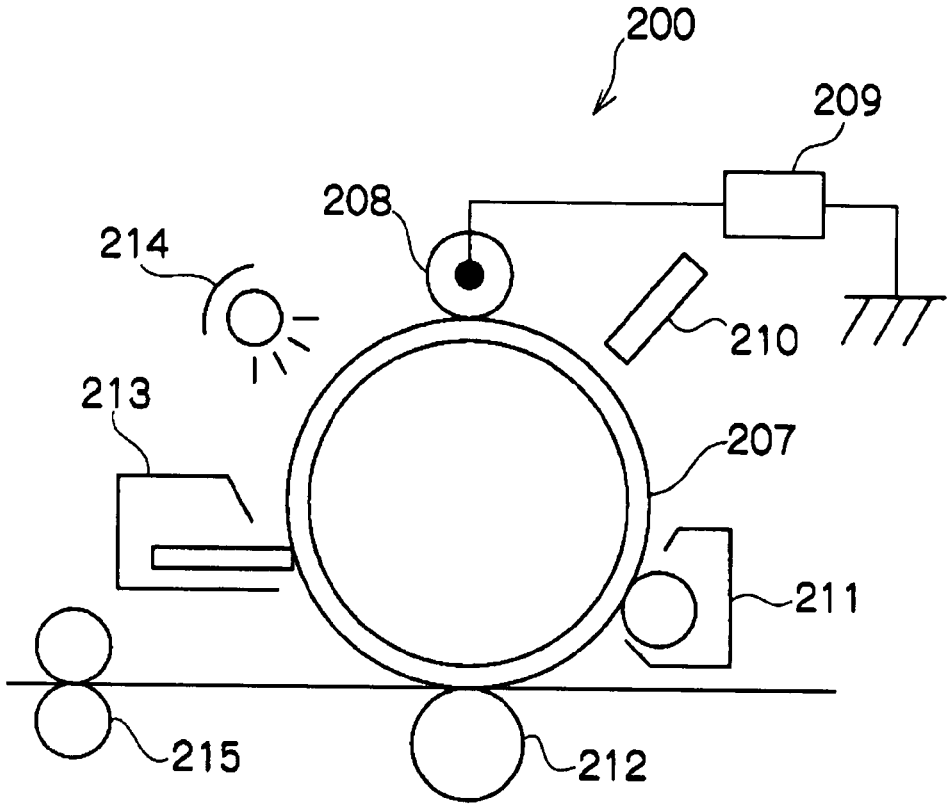
FIG. 18 is a schematic view of an image forming apparatus according to the first embodiment of the invention.

FIG. 18 is a schematic view of the image forming apparatus according to the first embodiment of the invention. The image forming apparatus 200 shown in FIG. 18 includes a latent image holding member 207, a charging device 208 for charging the latent image holding member 207 by a contact charging system, a power supply 209 connected to the charging device 208, an exposure device 210 for exposing the latent image holding member 207 charged with the charging device 208 to light to form an electrostatic latent image, a developing device 211 for developing the electrostatic latent image formed by the exposure device 210 with a toner to form a toner image, a transfer device 212 for transferring the toner image formed by the developing device 211 onto an image-receiving medium, a cleaning device 213, an erasing device 214, and a fixing device of the invention 215. Although not shown in FIG. 18, the image forming apparatus is also provided with a toner feeding device for feeding a toner to the developing device 211. In an embodiment different from this embodiment, the erasing device 214 may not be provided.

A toner image forming unit is constituted by the latent image holding member 207, charging device 208, power supply 209, exposure device 210, developing device 211, transfer device 212, cleaning device 213 and the erasing device 214.

The charging device 208 is a device for charging the surface of the latent image holding member at a predetermined potential by contacting an electroconductive member (charging roll) with the surface of the latent image holding member 207 and uniformly applying voltage to the latent image holding member. The charging device disposed in the image forming apparatus of the invention may be a charging device of non-contact charging type such as a corotron or scorotron.

When the electroconductive member is used to charge the latent image holding member 207, voltage is applied to the electroconductive members, wherein the voltage to be applied may be either direct-current voltage or direct-current voltage superimposed with alternating-current voltage. In addition to the charging roll shown in this embodiment, charging may also be conducted using a contact charging-type charging device such as a charging brush, charging film or a charging tube. Further, charging may also be conducted using a non-contact charging-type charging device such as a corotron or scorotron.

As the exposure device 210, an optical device capable of performing desired imagewise exposure to the surface of the latent image holding member 207 with a light source such as semiconductor laser, LED (light emitting diode) or liquid crystal shutter can be used. Among these, when an exposure device capable of exposing with incoherent light is used, generation of interference pattern between an electroconductive support and a photosensitive layer that constitutes the latent image holding member 207.

The developing unit 211 may be, for example, an ordinary developing device capable of developing an electrostatic latent image by allowing the device to be in contact, or in non-contact, with a magnetic (or non-magnetic) one-component (or two-component) developer. The developing device is not particularly limited as far as it has the aforementioned function, and can be appropriately selected depending on purposes.

Examples of the transfer devices for the transfer device 212 include not only a roller-type contact charging member but also a contact-type transfer charging device using a belt, film, rubber blade or the like, and the devices utilizing corona eject such as a scorotron transfer charging device and a corotron transfer charging device.

The cleaning device 213 is provided for removing of residual toner adhering to the surface of the latent image holding member after a toner image has been transferred. The latent image holding member having a surface cleaned with the cleaning device is used repeatedly in the image forming process described above. The cleaning device may be not only the one using a cleaning blade shown in the figure, but also other method such as brush cleaning, roll cleaning, but among these, the cleaning blade is preferably used. The material of the cleaning blade can be exemplified by urethane rubber, neoprene rubber, silicone rubber or the like.

The image-forming apparatus in this embodiment is provided with a erasing device (erase light-irradiating device) 214, as shown in FIG. 18. When the static eliminator is used in the case of repeatedly using the latent image holding member, the phenomenon of bringing the residual potential of the latent image holding member into the next image forming cycle can be prevented, thereby further improving image qualities.

Second Embodiment

Figure 19:
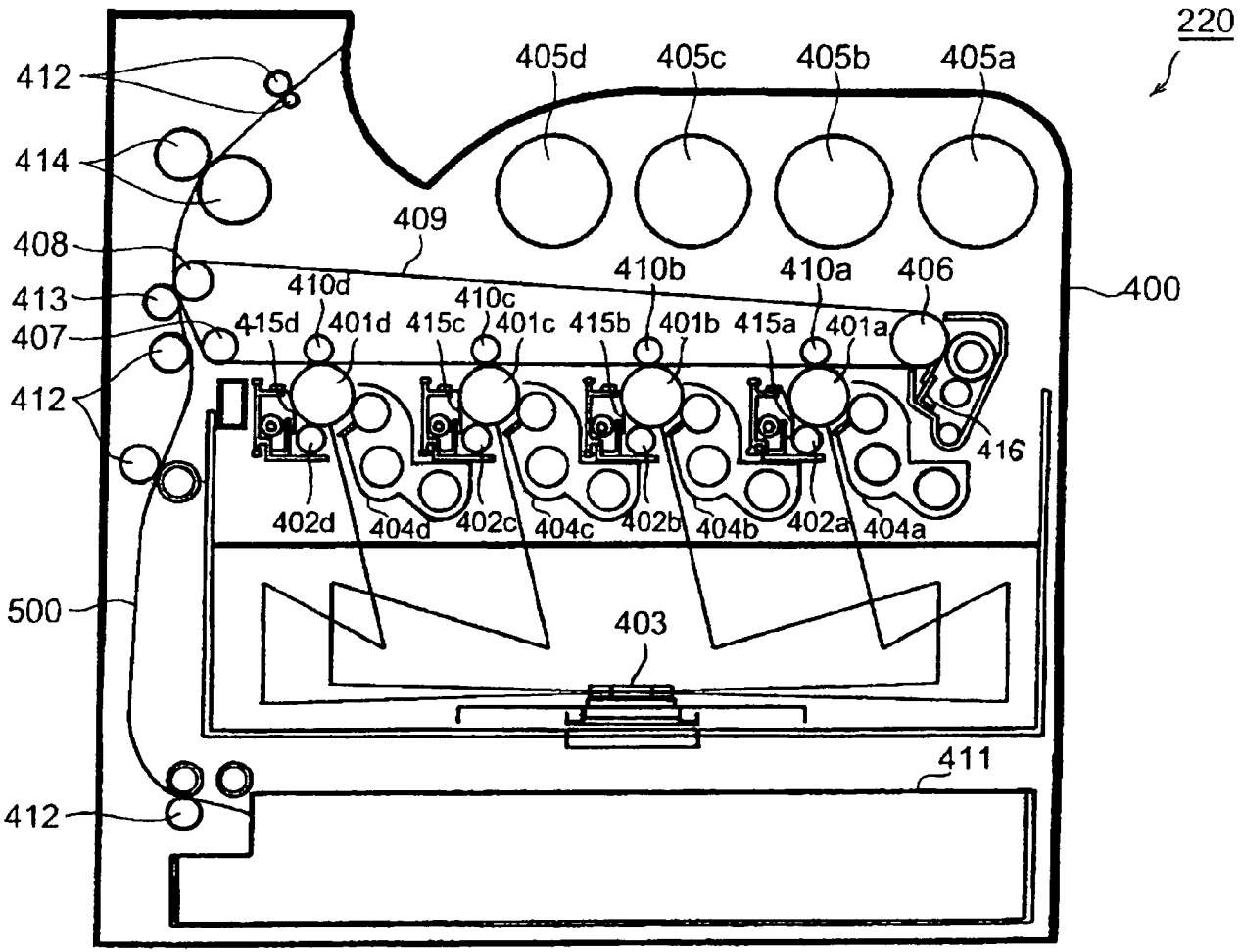
FIG. 19 is a schematic view of an image forming apparatus according to the second embodiment of the invention.

FIG. 19 is a schematic view of the image forming apparatus according to the second embodiment of the invention. The image forming apparatus 220 shown in FIG. 19 is an intermediate transferring-type electrophotographic apparatus, and in a housing 400, four latent image holding members 401*a* to 401*d* (for example, images of yellow, magenta, cyan and black can be respectively formed by each of the latent image holding members 401*a*, 401*b*, 401*c* and 401*d*) are arranged in parallel with one another along the intermediate transfer belt 409.

In the image forming apparatus described above, four toner image-forming units respectively corresponding to the above-mentioned four colors are provided, and a toner image-forming unit for yellow, for example, is composed of a latent image holding member 401*a*, a charging roll 402*a*, a developing device 404*a*, a primary transfer roll 410*a*, and a cleaning blade 415*a*.

The latent image holding member 401*a* can be rotated in a predetermined direction (anticlockwise direction in the figure), and the charging roll 402*a*, developing device 404*a*, primary transfer roll 410*a*, and cleaning blade 415*a* are arranged along this rotation direction. The developing device 404*a* can be supplied with a yellow toner contained in a toner cartridge 405*a*, and the primary transfer roll 410*a* contacts the latent image holding member 401*a* via the intermediate transfer belt 409.

The above constitution also applies to the cases of the toner image forming units for cyan, magenta and black.

In the housing 400, a laser light source (exposure device) 403 is further provided at the predetermined position, and from which laser light can be emitted and applied to the surfaces of the latent image holding members 401*a* to 401*d* after charging.

By the constitution described above, charging, exposure, development, primary transferring and cleaning are carried out in this order when the latent image holding members 401*a* to 401*d* are rotated at the time of image formation, and toner images of respective colors are transferred onto the intermediate transfer belt 409, overlapping each other.

The intermediate belt 409 is supported by a driving roll 406, backup roll 408 and a tension roll 407 with a predetermined degree of tension, and is capable of rotating without sagging by the rotation of the above rolls. A secondary transfer roll 413 is arranged so as to be in contact with the backup roll 408 via the intermediate transfer belt 409. The intermediate transfer belt 409, arranged so as to be sandwiched between the backup roll 408 and the secondary transfer roll 413, is cleaned with a cleaning blade 416 disposed, for example, on the position opposite the outer periphery of the driving roll 406, and then used repeatedly in the subsequent image forming processes.

A recording medium holder 411 is arranged at a predetermined position in the housing 400, and a recording medium 500 such as a paper sheet placed in the recording medium holder 411 is transferred via a transfer roll 412 to a contact portion between the intermediate transfer belt 409 and the secondary transfer roll 413, then to the fixing device 414 of the invention, and ejected out of the housing 400.

In the example described above, the intermediate transfer belt 409 is used as an intermediate transfer body, but the intermediate transfer body may be in the form of a belt, as is the case with the intermediate transfer belt 409, or may be in the form of a drum.

The recording medium is not particularly limited insofar as a toner image formed on the latent image holding member can be fixed onto the surface thereof, and may be made of paper, resin film or the like.

EXAMPLES

Hereinafter, the invention is described in more detail by referring to the Examples, but the invention is not limited thereto.

Example 1

<Preparation of Base Roll>

The outer periphery of a cylindrical core made of aluminum (material; CM-10, outer diameter; 26 mm, wall thickness; 1.5 mm, length; 400 mm) is subjected to a pretreatment by degreasing with toluene, and applying a rubber primer (trade name: DY35-051A/B, manufactured by Dow Corning Toray Silicon, Co., Ltd.) onto the region to be coated with an elastic layer (the region of 350 mm in length, i.e., excluding the regions at the both ends of 25 mm, respectively, from the total length of 400 mm) using a brush. Then, this cylindrical core is air-dried for 30 minutes and baked for 30 minutes in an oven at 150° C.

Subsequently, the pretreated cylindrical core is set in a cylindrical metallic sleeve frame having an inner diameter of 27 mm and fixed at the center of the sleeve frame with upper and lower cap flames. In this state, liquid silicone rubber (trade name: DX35-2120A/B, manufactured by Dow Corning Toray Silicon, Co., Ltd.) is cast from a die gate into a difference between the outer periphery of the cylindrical core and the inner periphery of the sleeve frame and baked for 1 hour in an oven at 170° C. to obtain a base roll having an elastic layer formed on the outer periphery of the cylindrical core.

<Formation of Surface Layer>

-PFA Dispersion-

Two kinds of commercially available PFA dispersions as shown below are used for formation of a surface layer.

(1) PFA Dispersion A (Trade Name; PFA 350-J, Manufactured by Du Pont-Mitsui Fluorochemicals, Co., Ltd.)

This dispersion contains, as PFA resin components, first PFA resin particles having an average particle diameter of 0.2 μm and second PFA resin particles having an average particle diameter of 8 μm, wherein the value of the mass fraction "first PFA resin particles/second PFA resin particles" is 75/25.

According to the copolymerization ratio of the monomers used in polymerization of PFA resin as measured by solid $^{19}$F-NMR and solid $^{13}$C-NMR, the copolymerization ratio of perfluoropropyl vinyl ether based on the total amount of the monomers used in copolymerization is 1.6 mol %.

(2) PFA Dispersion B (Trade Name; PFA 950HP-Plus, Manufactured by Du Pont-Mitsui Fluorochemicals, Co., Ltd.)

This dispersion contains, as PFA resin components, first PFA resin particles having an average particle diameter of 0.2 μm and second PFA resin particles having an average particle diameter of 8 μm, wherein the value of the mass fraction "first PFA resin particles/second PFA resin particles" is 75/25.

According to the copolymerization ratio of the monomers used in polymerization of PFA resin as measured by solid $^{19}$F-NMR and solid $^{13}$C-NMR, the copolymerization ratio of perfluoropropyl vinyl ether based on the total amount of the monomers used in copolymerization is 3.1 mol %.

-Pretreatment of Base Roll-

Subsequently, the surface of the base roll is coated with a primer for silicone rubber (trade name: PR-990CL, manufactured by Du Pont-Mitsui Fluorochemicals, Co., Ltd.) by spray coating to obtain a film of 1 μm in thickness, then heat-treated for 30 minutes in a circulatory oven set at 100° C.

-Coating Device (Ink Jet Device)-

As a liquid droplet discharging head, the integrated head shown in FIG. 5 is used. This integrated head (Pixel Jet 64, a head for an ink jet recording device, manufactured by Trident International, Inc.) is a piezo intermittent-type head wherein one liquid droplet discharging head has 32 nozzles×2 arrays. In formation of a surface layer, an ink tank is charged with PFA dispersions A and B so that the dispersions are ejected from adjacent two liquid droplet discharging heads, respectively.

As shown in FIG. 5, the base roll is arranged so that the axis thereof is in a horizontal direction, and is capable of rotating at a predetermined speed upon ejecting liquid droplets from the liquid droplet discharging head onto the base roll.

The integrated head is arranged so that the head can scan the base roll in the axial direction in such a manner that the minimum distance between the top of the base roll and the face on which the nozzle spouts of the liquid droplet discharging head are arranged, at the position right above of the base roll in the axial direction thereof, is kept to be 10 mm. The integrated head is arranged such that the lines of the nozzles of each liquid droplet discharging head are perpendicular to the axial direction of the base roll.

The amount of the liquid droplets ejected per unit time from the liquid droplet discharging head is controlled by the number of liquid droplets ejected per unit time by regulating the frequency of pulse applied to the piezoelectric element, while maintaining the diameter of liquid droplets ejected from the nozzles constant.

The average volume of a liquid droplet ejected from the liquid droplet discharging head is 20 pl, from the liquid droplet diameter determined from an image obtained by a CCD camera, by flashing LED to an ink droplet in synchronization with the timing of ejecting.

-Formation of Surface Layer (Formation of Coating Film)-

Using the coating device described above, two types of PFA dispersions are ejected onto the surface of the base roll in a predetermined amount, while the base roll is rotated at a rate of 200 rpm and scanned with the integrated head at a rate of 0.3 mm/min. from one end to the other end of the region where the elastic layer is formed on.

The total amount of the two types of PFA dispersions ejected per unit time is set to be constant (0.00077 ml/min), and the ratio of ejecting amount of the PFA dispersion B is set at 100% at the center of the base roll (position 175 mm apart from either end in the axial direction of the elastic layer), and the ratio of ejecting amount of the PFA dispersion A is set at 100% at the both ends of the base roll (positions 0 mm or 350 mm apart from either end in the axial direction of the elastic layer).

The amount of the liquid droplets ejected from the liquid droplet ejecting head is regulated such that when the integrated head moves from one end to the center, the ratio of ejecting amount of the PFA dispersion A decreases by 1% and the ratio of ejecting amount of the PFA dispersion B increases by 1%, every 1.75 mm scanning distance. When the integrated head moves from the center to the other end, the ratio of ejecting amount of the PFA dispersion A increases by 1% and the ratio of ejecting amount of the PFA dispersion B decreases by 1% every 1.75 mm scanning distance. Consequently, a coating film having a thickness of 30 μm is formed on the surface of the elastic layer.

Figure 20:
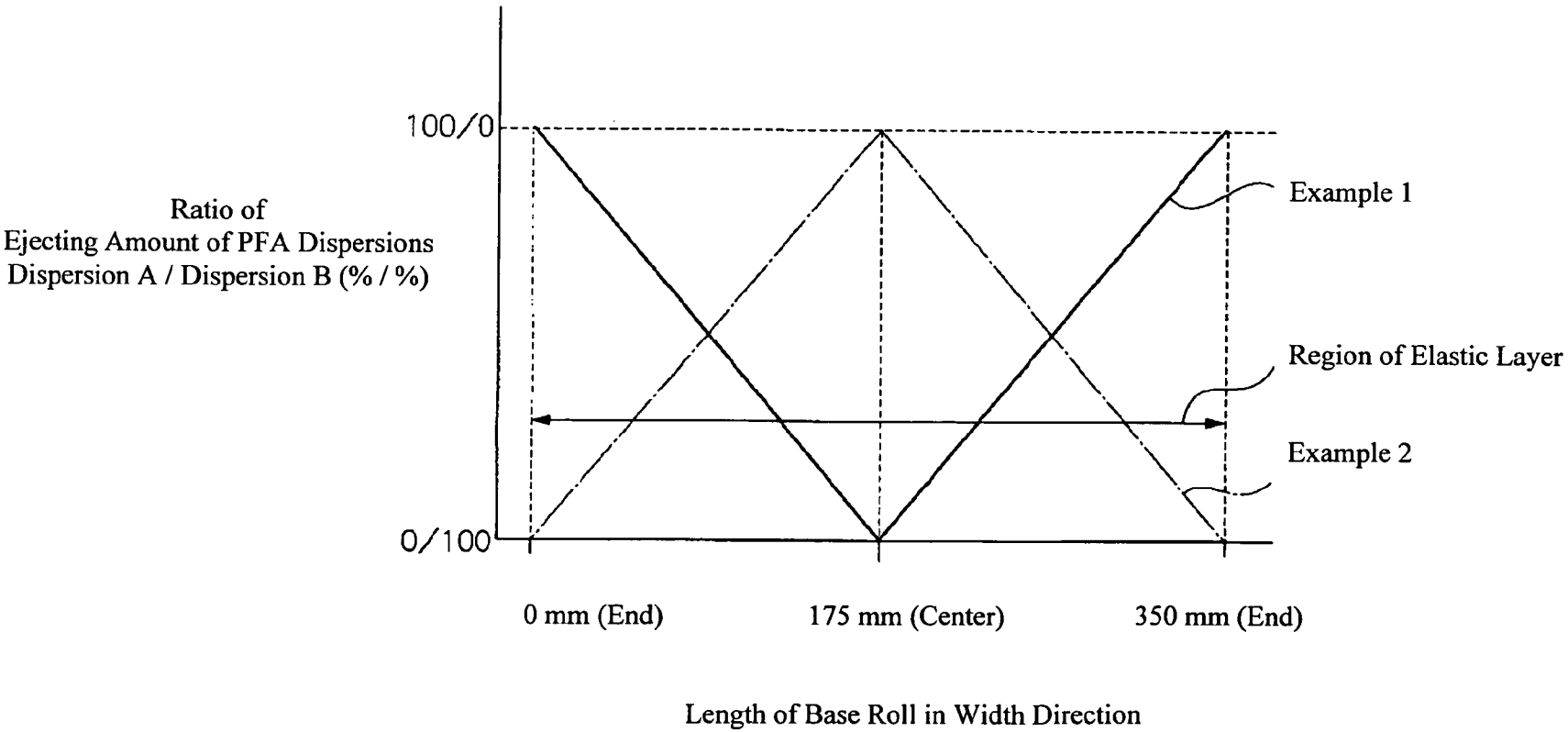
FIG. 20 is a graph showing a variation in the proportion of the discharge amount of two types of tetrafluoroethylene/perfluoroalkyl vinyl ether copolymer dispersions in the axial direction of a base roll, in the production of the fixing rolls according to Examples 1 and 2.

The variation in the ejecte ratios of the two kinds of PFA dispersions in the axial direction of the base roll in the above process is shown in FIG. 20 (the variation indicated by the solid line), for reference.

-Formation of Surface Layer (Drying and Baking)-

Subsequently, the roll having a coating film formed on the surface of the elastic layer thereof is rotated at 20 rpm, and dried simultaneously for 15 minutes in a circulatory oven at 90° C. Thereafter, the roll is baked for 30 minutes in a baking oven at 320° C. to obtain a fixing roll.

-Evaluation of Various Characteristic Values of Fixing Roll-

The resulting fixing roll is evaluated according to the difference in the width direction between the maximum value and minimum value of the total thickness of the support together with all the layers arranged on or above the support (total thickness unevenness), the average thickness of the surface layer, the difference in the width direction between the maximum value and minimum value of the thickness of the surface layer (thickness unevenness of the surface layer), and the dynamic friction coefficient at 120° C. on the surface of the surface layer.

The dynamic friction coefficient at 120° C. on the surface of the surface layer is evaluated by using a measurement sample which is formed not on the surface of the elastic layer but on a polyimide film under the same conditions as that for preparing of the fixing roll. Five levels of measurement samples are prepared in which the ratios of ejecting amount of PFA dispersion A/PFA dispersion B are 0/100, 25/75, 50/50, 75/25, and 100/0, respectively, and are measured by the measurement method described above. The results are shown in Table 1.

From the results shown in Table 1, it is found that the dynamic friction coefficient decreases as the ratio of ejecting amount of the PFA dispersion B to that of the PFA dispersion A decreases. From the results shown in Table 1 and FIG. 20, the variation in the dynamic friction coefficient in the width direction of the surface layer has a decreasing profile in which the dynamic friction coefficient decreases in a linear manner in the direction from the center to the both ends.

From the above results, it can be understood that in the width direction of the surface of the surface layer, the dynamic friction coefficient at the center is 0.366, the dynamic friction coefficient at positions 160 mm apart from the center toward the two ends is 0.312, and the difference thereof is 0.054.

TABLE 1

| PFA Dispersion A:PFA Dispersion B (%:%) | Dynamic friction coefficient |
|---|---|
| 0:100 | 0.366 |
| 25:75 | 0.350 |
| 50:50 | 0.337 |
| 75:25 | 0.320 |
| 100:0 | 0.307 |

The evaluation results of the total thickness unevenness, average thickness of the surface layer, and the thickness unevenness of the surface layer are shown in Table 3, together with the evaluation results of paper crease described later.

-valuation of Paper Crease-

The resulting fixing roll is attached as the pressing roll in the image forming apparatus (trade name: DocuCentre Color 500, manufactured by Fuji Xerox Co., Ltd.) including a pair of fixing rolls of a heat roll and a pressing roll as a fixing device. In this fixing device, the heat roll serves as a fixing roll at the driving side, and the pressing roll serves as a fixing roll at the driven side. A paper sheet delivered through the apparatus is modified such that the central line thereof conforms with the center of the surface layer of the pressing roll.

Evaluation of paper crease is carried out by setting the fixing temperature at 160° C. and the process speed at 220 mm/s, and A4-size paper sheets (S paper, manufactured by Fuji Xerox Co., Ltd.) are fed such that the shorter direction thereof comes in the direction of delivery, and 50% halftone black images are formed on the whole surfaces of 100,0000 sheets in succession, by oilless fixing. Evaluation of the effect of preventing paper crease, as well as whether the effect with time or not, is made by sampling a ten paper sheets after image formation at an early stage of the printing test (around the 100th sheet) and a paper sheet after image formation at a late stage of the printing test (around the 100,000th sheet). The results are shown in Table 3. Evaluation criteria of paper crease shown in Table 3 are as follows:

A: No paper crease is observed.

B: Subtle waving but no crease is observed in up to five paper sheets out of ten.

C: Paper crease is observed in up to three paper sheets out of ten.

D: Paper crease is observed in more than three paper sheets out of ten.

-Evaluation of Toner Adhesion-

Using the image forming apparatus used in the above-described evaluation of paper crease, 20 mm×20 mm images of yellow, magenta, cyan and black with 100% density is formed and fixed onto the front edges of five A3 paper sheets (P paper, manufactured by Fuji Xerox Co., Ltd.), then evaluated according to the following criteria. The results are shown in Table 3.

A: No image offset is observed.

B: Very slight offset is observed on up to three out of five sheets (hardly observable level).

C: Very slight offset is observed on up to three out of five sheets (visually recognizable but not remarkable on the image).

D: Visible offset is observed on at least one out of five sheets.

-Evaluation of Image Defects (Lines Defects)-

Evaluation is made as to whether striated defects due to the unevenness of the surface of the surface layer are generated on the resulting image, according to the following criteria. The results are shown in Table 3.

A: No image defect is observed.

B: Very thin lines are observed when lighted.

C: Thin lines are observed by ordinary observation but are not remarkable.

D: Lines are clearly observed.

Example 2

A fixing roll is prepared in the same manner as in Example 1 except that the amount of the liquid droplets ejected from the liquid droplet discharging head is regulated such that when the two types of PFA dispersions used in Example 1 are applied onto the base roll, the ratio of ejecting amount of the PFA dispersion A is set at 100% at the center, and the ratio of ejecting amount of the PFA dispersion B is set at 100% at the both ends, and when the integrated head moves from one end to the center, the ratio of ejecting amount of the PFA dispersion A increases by 1% and the ratio of ejecting amount of the PFA dispersion B decreases by 1%, every 1.75 mm scanning distance, and when the integrated head moves from the center to the other end, the ratio of ejecting amount of the PFA dispersion A decreases by 1% and the ratio of ejecting amount of the PFA dispersion B increases by 1%, every 1.75 mm scanning distance.

The variation in the ratio of ejecting amount of the two types of PFA dispersions in the axial direction of the base roll in the above process is shown in FIG. 20 (the variation indicated by the dashed-dotted line), for reference. From the results shown in Table 1 and FIG. 20, the variation in dynamic friction coefficient in the width direction of the surface layer has an increasing profile in which the dynamic friction coefficient increases in a linear manner in a direction from the center toward the both ends.

From the above results, it can be understood that in the width direction of the surface of the surface layer, the dynamic friction coefficient at the center is 0.307, the dynamic friction coefficient at positions 160 mm apart from the center to the ends is 0.361, and the difference thereof is 0.054.

Evaluations on paper crease or the like are made in the same manner as in Example 1, except that the obtained fixing roll is attached as the heat roll in the image forming apparatus used in Example 1. The results are shown in Table 3.

Example 3

-PFA Dispersion-

For formation of the surface layer, a PFA dispersion C shown below is used together with the PFA dispersion A used in Example 1.

PFA Dispersion C (trade name: PFA 920HP-Plus, manufactured by Du Pont-Mitsui Fluorochemicals, Co., Ltd.)

This dispersion contains, as PFA resin components, first PFA resin particles having an average particle diameter of 0.2 μm and second PFA resin particles having an average particle diameter of 8 μm, wherein the value of the mass fraction "first PFA resin particle/second PFA resin particle" is 75/25.

According to the copolymerization ratio of the monomers used in polymerization of PFA resin as measured by solid $^{19}$F-NMR and solid $^{13}$C-NMR, the copolymerization ratio of perfluoropropyl vinyl ether based on the total amount of the monomers used in copolymerization is 3.1 mol %.

The dynamic friction coefficients when the ratios of dispersions A/dispersion C are changed are shown in Table 2.

TABLE 2

| PFA Dispersion A:PFA Dispersion C (%:%) | Dynamic friction coefficient |
|---|---|
| 0:100 | 0.495 |
| 25:75 | 0.440 |
| 50:50 | 0.391 |
| 75:25 | 0.356 |
| 100:0 | 0.307 |

-Preparation of Fixing Roll-

A fixing roll is obtained in the same manner as in Example 1 except that the dispersion C is used in place of the PFA dispersion B in Example 1.

The dynamic friction coefficients in the width direction on the surface of the surface layer are 0.495 at the center and 0.323 at the positions 160 mm apart from the center toward the both ends, the difference thereof being 0.172.

Evaluations on paper crease and the like are made in the same manner as in Example 1 except that the obtained fixing roll is attached as the pressing roll in the image forming apparatus used in Example 1. The results are shown in Table 3.

Example 4

A fixing roll is prepared in the same manner as in Example 1 except that the amount of the liquid droplets ejected from the liquid droplet discharging head is regulated such that when the two types of PFA dispersions used in Example 1 are applied onto the base roll, the ratio of ejecting amount of the PFA dispersion A is set at 100% at the center, and the ratio of ejecting amounts of the PFA dispersions A and B are respectively set at 25% and 75% at the both ends, and when the integrated head moves from one end to the center, the ratio of ejecting amount of the PFA dispersion A increases by 0.75% and the ratio of ejecting amount of the PFA dispersion B decreases by 0.75%, every 1.75 mm scanning distance, and when the integrated head moves from the center to the other end, the ratio of ejecting amount of the PFA dispersion A decreases by 0.75% and the ratio of ejecting amount of the PFA dispersion B increases by 0.75%, every 1.75 mm scanning distance.

From the above results, it can be understood that in the width direction of the surface of the surface layer, the dynamic friction coefficient at the center is 0.307, the dynamic friction coefficients at the positions 160 mm apart from the center toward the ends is 0.346, and the difference thereof is 0.039.

Evaluations on paper crease or the like are made in the same manner as in Example 1, except that the obtained fixing roll is attached as the heat roll in the image forming apparatus used in Example 1. The results are shown in Table 3.

Example 5

A fixing roll is prepared in the same manner as in Example 1 except that the amount of the liquid droplets ejected from the liquid droplet discharging head is regulated such that when the two types of PFA dispersions used in Example 1 are applied onto the base roll, the ratio of ejecting amount of the PFA dispersions A and B are respectively set at 50% and 50% at the center, and the ratio of ejecting amounts of the PFA dispersions A and B are respectively set at 100% and 0% at the both ends, and when the integrated head moves from one end to the center, the ratio of ejecting amount of the PFA dispersion A decreases by 0.5% and the ratio of ejecting amount of the PFA dispersion B increases by 0.5%, every 1.75 mm scanning distance, and when the integrated head moves from the center to the other end, the ratio of ejecting amount of the PFA dispersion A increases by 0.5% and the ratio of ejecting amount of the PFA dispersion B decreases by 0.5%, every 1.75 mm scanning distance.

From the above results, it can be understood that in the width direction of the surface of the surface layer, the dynamic friction coefficient at the center is 0.337, the dynamic friction coefficients at the positions 160 mm apart from the center toward the ends is 0.310, and the difference thereof is 0.027.

Evaluations on paper crease or the like are made in the same manner as in Example 1, except that the obtained fixing roll is attached as the pressing roll in the image forming apparatus used in Example 1. The results are shown in Table 3.

Example 6

A fixing roll is prepared in the same manner as in Example 1 except that the amount of the liquid droplets ejected from the liquid droplet discharging head is regulated such that when the two types of PFA dispersions used in Example 1 are applied onto the base roll, the ratio of ejecting amount of the PFA dispersions A is set at 100% at the center, and the ratio of ejecting amounts of the PFA dispersions A and B are respectively set at 75% and 25% at the both ends, and when the integrated head moves from one end to the center, the ratio of ejecting amount of the PFA dispersion A increases by 0.25% and the ratio of ejecting amount of the PFA dispersion B decreases by 0.25%, every 1.75 mm scanning distance, and when the integrated head moves from the center to the other end, the ratio of ejecting amount of the PFA dispersion A decreases by 0.25% and the ratio of ejecting amount of the PFA dispersion B increases by 0.25%, every 1.75 mm scanning distance.

From the above results, it can be understood that in the width direction of the surface of the surface layer, the dynamic friction coefficient at the center is 0.307, the dynamic friction coefficients at positions 160 mm apart from the center toward the ends is 0.319, and the difference thereof is 0.012.

Evaluations on paper crease or the like are made in the same manner as in Example 1, except that the obtained fixing roll is attached as the heat roll in the image forming apparatus used in Example 1. The results are shown in Table 3.

Comparative Example 1

As the fixing roll in the image forming apparatus used in Example 1, a fixing roll is prepared in the same manner as in Example 1 except that only PFA dispersion A is used for the PFA dispersion.

Evaluations on paper crease or the like are made in the same manner as in Example 1, except that the obtained fixing roll is attached as the heat roll in the image forming apparatus used in Example 1. The results are shown in Table 4.

Comparative Example 2

The surface of the fixing roll prepared in Comparative Example 1 is washed with acetone and air-dried for 30 minutes at room temperature.

Subsequently, the fixing roll after being dried is equally divided in the width direction into seven regions at 50-mm intervals, and five regions out of the seven equal regions (the region from 50 mm to 300 mm in the width direction of the fixing roll, when the length between the both ends is 350 mm) excluding two regions at the both the ends (the regions of from 0 mm to 50 mm and from 300 to 350 mm, when the length between the both ends is 350 mm) are masked with a polyethylene masking tape, and the non-masked two regions at the both ends are treated with Tetra Etch (manufactured by Junkosha Inc.) for five seconds, and then the treatment solution is wiped off with ethanol, thereafter the fixing roll is washed with water for 5 minutes.

Then, the fixing roll is subjected to the same surface treatment as above, except that the five regions (the regions of from 0 mm to 50 mm, from 100 mm to 250 mm and from 300 mm to 350 mm) out of the seven regions excluding the two regions adjacent to the two regions at the both ends (the regions of from 50 mm to 100 mm and from 250 to 300 mm) are masked with a polyethylene masking tape, and also that the treatment time is three seconds.

Finally, the fixing roll is subjected to the same surface treatment as above except that five regions (the regions of from 0 mm to 100 mm, from 150 mm to 200 mm and from 250 mm to 350 mm) out of the seven regions excluding the two regions located at the side of the center and adjacent to the two regions that have been subjected to the above surface treatment (the regions of from 100 mm to 150 mm and from 200 to 250 mm) are masked with a polyethylene masking tape, and also that the treatment time is one second.

The central region (the region of from 150 mm to 200 mm) is not subjected to a surface treatment.

The measurement results of that the friction coefficients of a surface layer sheet that has been subjected to the same treatment as above is 0.571 after treated for a treatment time of five seconds, 0.462 for a treatment time of three seconds, and 0.399 for a treatment time of one second.

Evaluations on paper crease or the like are made in the same manner as in Example 1, except that the obtained fixing roll is attached as the heat roll in the image forming apparatus used in Example 1. The results are shown in Table 4.

All publications, patent applications, and technical standards mentioned in this specification are herein incorporated by reference to the same extent as if each individual publication, patent application, or technical standard was specifically and individually indicated to be incorporated by reference.

TABLE 3

| | | Example 1 | Example 2 | Example 3 | Example 4 | Example 5 | Example 6 |
|---|---|---|---|---|---|---|---|
| Properties of Fixing Member | Total thickness unevenness (μm) | 18 | 21 | 21 | 21 | 21 | 21 |
| | Average thickness of surface layer (μm) | 30 | 30 | 30 | 30 | 30 | 30 |
| | Thickness unevenness of surface layer (μm) | 1 | 1 | 2 | 2 | 2 | 2 |
| | Profile of dynamic friction coefficient | Decrease | Increase | Decrease | Increase | Decrease | Increase |
| | Dynamic friction coefficient A at the center | 0.366 | 0.307 | 0.495 | 0.307 | 0.337 | 0.307 |
| | Dynamic friction coefficient B at a point 160 mm apart from the center toward the end | 0.312 | 0.361 | 0.323 | 0.346 | 0.310 | 0.319 |
| | Absolute value of (dynamic friction coefficient A) − (dynamic friction coefficient B) | 0.054 | 0.054 | 0.172 | 0.039 | 0.027 | 0.012 |
| Mounting Position of Fixing Member in Fixing Device | | Driven side (pressing roll) | Driving side (heat roll) | Driven side (pressing roll) | Driving side (heat roll) | Driven side (pressing roll) | Driving side (heat roll) |
| Evaluation of Paper Crease | Initial stage of printing test | A | A | A | A | A | A |
| | Before completion of printing test | A | A | A | A | A | B |
| | Toner adhesion | A | A | A | A | B | A |
| | Image Defects (Striated Defects) | A | A | A | A | A | A |

TABLE 4

| | | Comparative Example 1 | Comparative Example 2 |
|---|---|---|---|
| Properties of Fixing Member | Total thickness unevenness (μm) | 22 | 21 |
| | Average thickness of surface layer (μm) | 29 | 30 |
| | Thickness unevenness of surface layer (μm) | 1 | 2 |
| | Profile of dynamic friction coefficient | Constant in the width direction | Stepwise increase |
| | Dynamic friction coefficient A at the center | 0.307 | 0.307 |
| | Dynamic friction coefficient B at a point 160 mm apart from the center toward the end | 0.307 | 0.571 |
| | Absolute value of (dynamic friction coefficient A) − (dynamic friction coefficient B) | 0 | 0.264 |
| Mounting Position of Fixing Member in Fixing Device | | Driving side (heat roll) | Driving side (heat roll) |
| Evaluation of Paper Crease | Initial stage of printing test | D | B |
| | Before completion of printing test | D | D |
| | Toner Adhesion | A | D |
| | Image Defects (Striated Defects) | A | D |

What is claimed is:

1. A fixing member comprising: a substantially cylindrical support and one or more layers provided on or above the support, including a surface layer that constitutes the outermost surface, the fixing member having:

a difference in the width direction of the support between the maximum value and minimum value of the total thickness of the support together with all the layers provided on or above the support being approximately 50 μm or less;

the surface layer consisting of a seamless member comprising a fluorine-containing solid material, the composition of the fluorine-containing solid material varying in the width direction of the support;

the average thickness of the surface layer being in the range of approximately 20 μm to approximately 50 μm;

a difference in the width direction of the support between the maximum value and minimum value of the thickness of the surface layer being approximately 5 μm or less; and the dynamic friction coefficient on the surface of the surface layer at 120° C. varying in the width direction of the support.

2. The fixing member according to claim 1, wherein the length of the surface layer in the width direction of the support is in the range of approximately 220 mm to approximately 250 mm, and wherein the difference in the width direction of the support between the dynamic friction coefficient at 120° C. at the center of the surface layer and the dynamic friction coefficient at 120° C. at positions approximately 110 mm apart from the center toward the two ends is in the range of approximately 0.03 to approximately 0.19.

3. The fixing member according to claim 1, wherein the length of the surface layer in the width direction of the support is in the range of approximately 320 mm to approximately 360 mm, and wherein the difference in the width direction of the support between the dynamic friction coefficient at 120° C. at the center of the surface layer and the dynamic friction coefficient at 120° C. at positions approximately 160 mm apart from the center toward the two ends is in the range of approximately 0.03 to approximately 0.19.

4. The fixing member according to claim 1, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer decreases in the width direction of the support from the center toward the two ends of the surface layer.

5. The fixing member according to claim 1, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer increases in the width direction of the support from the center to the two ends of the surface layer.

6. A fixing device comprising at least:

a heating member and;

a pressing member arranged to be in contact with the heating member, either one of the heating member or the pressing member being a fixing member at a driving side and the other member being a fixing member at a driven side driven by the fixing member at the driving side, the fixing member at the driving side comprising a substantially cylindrical support and one or more layers provided on or above the support, including a surface layer constituting the outermost surface, the difference in the width direction of the support between the maximum value and minimum value of the total thickness of the support together with all the layers provided on or above the support being approximately 50 μm or less, the surface layer consisting of a seamless member comprising a fluorine-containing solid material, the composition of the fluorine-containing solid material varying in the width direction of the support, the average thickness of the surface layer being in the range of approximately 20 μm to approximately 50 μm, the difference in the width direction of the support between the maximum value and minimum value of the thickness of the surface layer being approximately 5 μm or less, and the dynamic friction coefficient at 120° C. on the surface of the surface layer increasing in the width direction of the support from the center toward the two ends.

7. The fixing device according to claim 6, wherein the fixing member at the driving side is a fixing member having a length of the surface layer in the width direction of the support being in the range of approximately 220 mm to approximately 250 mm, and the difference in the width direction of the support between the dynamic friction coefficient at 120° C. at the center of the surface layer and the dynamic friction coefficients at 120° C. at positions approximately 110 mm apart from the center toward the two ends being in the range of approximately 0.03 to approximately 0.19.

8. The fixing device according to claim 6, wherein the fixing member at the driving side is a fixing member having a length of the surface layer in the width direction of the support being in the range of approximately 320 mm to approximately 360 mm, and the difference in the width direction of the support between the dynamic friction coefficient at 120° C. at the center of the surface layer and the dynamic friction coefficient at 120° C. at positions approximately 160 mm apart from the center toward the two ends being in the range of approximately 0.03 to approximately 0.19.

9. The fixing device according to claim 6, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer increases in the width direction of the support from the center toward the two ends of the surface layer.

10. A fixing device comprising at least:

a heating member and;

a pressing member arranged to be in contact with the heating member, either one of the heating member or the pressing member being a fixing member at a driving side and the other member being a fixing member at a driven side driven by the fixing member at the driving side, the fixing member at the driven side comprising a substantially cylindrical support and one or more layers provided on or above the support, including a surface layer constituting the outermost surface, the difference in the width direction of the support between the maximum value and minimum value of the total thickness of the support together with all the layers provided on or above the support being approximately 50 μm or less, the surface layer consisting of a seamless member comprising a fluorine-containing solid material, the composition of the fluorine-containing solid material varying in the width direction of the support, the average thickness of the surface layer being in the range of approximately 20 μm to approximately 50 μm, the difference in the width direction of the support between the maximum value and minimum value of the thickness of the surface layer being approximately 5 μm or less, and the dynamic friction coefficient at 120° C. on the surface of the surface layer decreasing in the width direction of the support from the center toward the two ends.

11. The fixing device according to claim 10, wherein the fixing member at the driven side is a fixing member having a length of the surface layer in the width direction of the support being in the range of approximately 220 mm to approximately 250 mm, and the difference in the width direction of the support between the dynamic friction coefficient at 120° C. at the center of the surface layer and the dynamic friction coefficients at 120° C. at positions approximately 110 mm apart from the center toward the two ends being in the range of approximately 0.03 to approximately 0.19.

12. The fixing device according to claim 10, wherein the fixing member at the driven side is a fixing member having a length of the surface layer in the width direction of the support being in the range of approximately 320 mm to approximately 360 mm, and the difference in the width direction of the support between the dynamic friction coefficient at 120° C. at the center of the surface layer and the dynamic friction coefficient at 120° C. at positions approximately 160 mm apart from the center toward the two ends being in the range of approximately 0.03 to approximately 0.19.

13. The fixing device according to claim 10, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer decreases in the width direction of the support from the center toward the two ends of the surface layer.

14. An image forming apparatus comprising at least a latent image holding member, a charging device for charging the surface of the latent image holding member, a latent image forming device for forming a latent image on the surface of the charged latent image holding member, a toner image forming device for developing the latent image with a developer to form a toner image, a transfer device for transferring the toner image from the surface of the latent image holding member onto the surface of a recording medium, and a fixing device for fixing the toner image transferred onto the surface of the recording medium, the fixing device comprising at least:

a heating member and;

a pressing member arranged to be in contact with the heating member, either one of the heating member or the pressing member being a fixing member at a driving side and the other member being a fixing member at a driven side driven by the fixing member at the driving side, the fixing member at the driving side comprising a substantially cylindrical support and one or more layers provided on or above the support, including a surface layer constituting the outermost surface, the difference in the width direction of the support between the maximum value and minimum value of the total thickness of the support together with all the layers provided on or above the support being approximately 50 μm or less, the surface layer consisting of a seamless member comprising a fluorine-containing solid material, the composition of the fluorine-containing solid material varying in the width direction of the support, the average thickness of the surface layer being in the range of approximately 20 μm to approximately 50 μm, the difference in the width direction of the support between the maximum value and minimum value of the thickness of the surface layer being approximately 5 μm or less, and the dynamic friction coefficient at 120° C. on the surface of the surface layer increasing in the width direction of the support from the center toward the two ends.

15. The image forming apparatus according to claim 14, wherein the fixing member at the driving side is a fixing member having a length of the surface layer in the width direction of the support being in the range of approximately 220 mm to approximately 250 mm, and the difference in the width direction of the support between the dynamic friction coefficient at 120° C. at the center of the surface layer and the dynamic friction coefficients at 120° C. at positions approximately 110 mm apart from the center toward the two ends being in the range of approximately 0.03 to approximately 0.19.

16. The image forming apparatus according to claim 14, wherein the fixing member at the driving side is a fixing member having a length of the surface layer in the width direction of the support being in the range of approximately 320 mm to approximately 360 mm, and the difference in the width direction of the support between the dynamic friction coefficient at 120° C. at the center of the surface layer and the dynamic friction coefficient at 120° C. at positions approximately 160 mm apart from the center toward the two ends being in the range of approximately 0.03 to approximately 0.19.

17. The image forming apparatus according to claim 14, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer increases in the width direction of the support from the center toward the two ends of the surface layer.

18. An image forming apparatus comprising at least a latent image holding member, a charging device for charging the surface of the latent image holding member, a latent image forming device for forming a latent image on the surface of the charged latent image holding member, a toner image forming device for developing the latent image with a developer to form a toner image, a transfer device for transferring the toner image from the surface of the latent image holding member onto the surface of a recording medium, and a fixing device for fixing the toner image transferred onto the surface of the recording medium, the fixing device comprising at least:

a heating member and;

a pressing member arranged to be in contact with the heating member, either one of the heating member or the pressing member being a fixing member at a driving side and the other member being a fixing member at a driven side driven by the fixing member at the driving side, the fixing member at the driven side comprising a substantially cylindrical support and one or more layers provided on or above the support, including a surface layer constituting the outermost surface, the difference in the width direction of the support between the maximum value and minimum value of the total thickness of the support together with all the layers provided on or above the support being approximately 50 μm or less, the surface layer consisting of a seamless member comprising a fluorine-containing solid material, the composition of the fluorine-containing solid material varying in the width direction of the support, the average thickness of the surface layer being in the range of approximately 20 μm to approximately 50 μm, the difference in the width direction of the support between the maximum value and minimum value of the thickness of the surface layer being approximately 5 μm or less, and the dynamic friction coefficient at 120° C. on the surface of the surface layer decreasing in the width direction of the support from the center toward the two ends.

19. The image forming apparatus according to claim 18, wherein the fixing member at the driven side is a fixing member having a length of the surface layer in the width direction of the support being in the range of approximately 220 mm to approximately 250 mm, and the difference in the width direction of the support between the dynamic friction coefficient at 120° C. at the center of the surface layer and the dynamic friction coefficients at 120° C. at the positions approximately 110 mm apart from the center toward the two ends being in the range of approximately 0.03 to approximately 0.19.

20. The image forming apparatus according to claim 18, wherein the fixing member at the driven side is a fixing member having a length of the surface layer in the width direction of the support being in the range of approximately 320 mm to approximately 360 mm, and the difference in the width direction of the support between the dynamic friction coefficient at 120° C. at the center of the surface layer and the dynamic friction coefficient at 120° C. at positions approximately 160 mm apart from the center toward the two ends being in the range of approximately 0.03 to approximately 0.19.

21. The image forming apparatus according to claim 18, wherein the fluorine-containing solid material comprises a tetrafluoroethylene/perfluoroalkyl vinyl ether copolymer, and the amount of oxygen atoms in the tetrafluoroethylene/perfluoroalkyl vinyl ether copolymer decreases in the width direction of the support from the center toward the two ends of the surface layer.

* * * * *